US005168296A

United States Patent [19]

Nakamura et al.

[11] Patent Number: 5,168,296

[45] Date of Patent: Dec. 1, 1992

[54] METHOD AND APPARATUS FOR PROCESSING PHOTOSENSITIVE MATERIAL

[75] Inventors: Takashi Nakamura; Toshio Kurokawa, both of Minami-ashigara, Japan

[73] Assignee: Fuji Photo Film Co., Ltd., Kanagawa, Japan

[21] Appl. No.: 685,313

[22] Filed: Apr. 15, 1991

Related U.S. Application Data

[63] Continuation-in-part of Ser. No. 340,820, Apr. 20, 1989, abandoned.

[30] Foreign Application Priority Data

| | | | |
|---|---|---|---|
| Apr. 20, 1988 | [JP] | Japan | 63-97785 |
| Feb. 3, 1989 | [JP] | Japan | 1-25132 |
| Feb. 6, 1989 | [JP] | Japan | 1-27034 |
| Mar. 14, 1989 | [JP] | Japan | 1-61707 |
| Apr. 10, 1989 | [JP] | Japan | 1-90422 |

[51] Int. Cl.[5] ..... G03D 3/08

[52] U.S. Cl. ..... 354/320; 354/323; 354/324

[58] Field of Search ..... 354/316, 320, 321, 322, 354/324, 338, 339, 323; 430/421, 428, 430, 455

[56] References Cited

U.S. PATENT DOCUMENTS 4,166,689 9/1979 Schausberger et al. ..... 354/321

4,710,009 12/1987 Schneider ..... 354/324 X

*Primary Examiner*—Michael L. Gellner

*Assistant Examiner*—D. Rutledge

*Attorney, Agent, or Firm*—Sughrue, Mion, Zinn, Macpeak & Seas

[57] ABSTRACT

Photosensitive material is processed by charging a plurality of serially arranged compartments defined in the interior chamber of a single processing tank with processing solution, and successively passing the photosensitive material through the compartments while maintaining continuous contact with the solution. The solution can be a developer, bleach-fix solution or wash water. An apparatus is also provided comprising a single tank, a plurality of compartments defined in the tank, and feed rollers in the compartments for feeding the photosensitive material through the compartments.

15 Claims, 20 Drawing Sheets

METHOD AND APPARATUS FOR PROCESSING PHOTOSENSITIVE MATERIAL

This application is a continuation-in-part application from U.S. Ser. No. 07/340,820 filed Apr. 20, 1989.

BACKGROUND OF THE INVENTION

This invention relates to a method and apparatus for wet processing photosensitive material, particularly silver halide photosensitive material.

In general, photosensitive material, particularly silver halide photosensitive material after exposure is subjected to a series of wet processing steps including development, fixation or bleach-fixation, and washing. Such a series of processing steps are most often carried out by means of an automatic developing machine having developing, fixing or bleach fixing, and washing tanks built therein. Photosensitive material is successively passed through the solutions in these tanks.

Environmental protection and resource saving are general demands. Photographic processing is not the exception. Saving processing solution, particularly developing solution is one of outstanding tasks in the art. Developing efficiency must be increased before developing solution can be saved. In fact, it is known that developing efficiency can be increased by the use of a plurality of developing tanks each containing a divided portion of developing solution. One known practical procedure capable of development with a less amount of developing solution is a multi-stage counter flow procedure usually including 2 to 9 stages.

Such a procedure utilizes a plurality of juxtaposed processing tanks, resulting in a relatively large size of apparatus requiring a relatively large space for installation. Also a reduction in consumption of developing solution or amount thereof replenished is still insufficient.

SUMMARY OF THE INVENTION

An object of the present invention is to provide a novel and improved photosensitive material processing apparatus capable of efficient processing and of a relatively small size requiring a relatively small space for installation.

Another object of the present invention is to provide a novel and improved method for processing photosensitive material at high efficiency with a less amount of processing solution and a less increment of processing solution replenished.

According to a first aspect of the present invention, there is provided a method for wet processing a photosensitive material, comprising the steps of providing a processing tank whose interior chamber is partitioned into a plurality of serially arranged compartments filled with processing solution, and successively passing the photosensitive material through the compartments without contact with the ambient atmosphere. Differently stated, the photosensitive material is passed through the compartments while maintaining continuous contact with the solution. In general, the compartments are allowed for fluid communication with each other and the processing solution flows through the compartments in counter flow relationship to the travel of the photosensitive material.

As processing of photosensitive material is repeated, a gradient is developed in solution composition among the compartments, and this gradient in solution composition among the compartments is maintained throughout the process.

According to a second aspect of the present invention, there is provided an apparatus for wet processing a photosensitive material, comprising a processing tank for defining an interior chamber; means for partitioning the tank chamber into a plurality of serially arranged compartments, the compartments being filled with processing solution; and means for successively passing the photosensitive material through the compartments while maintaining continuous contact with the solution. The partition means is designed such that any two adjoining compartments being in little or no fluid communication with each other during quiescent periods when no photosensitive material travels, but in fluid communication with each other during operating periods when the photosensitive material travels.

The apparatus may further include means for providing a flow of processing solution through the compartments in parallel or counter flow relationship to the travel of the photosensitive material. The apparatus may further include means for providing a flow of processing solution perpendicular to the travel direction of the photosensitive material.

BRIEF DESCRIPTION OF THE DRAWINGS

The above and other objects, features and advantages of the present invention will be better understood from the following description taken in conjunction with the accompanying drawings.

In the figures, like numerals designate like parts.

DESCRIPTION OF THE PREFERRED EMBODIMENTS

The photosensitive material which is processed in the apparatus generally takes the form of a web or sheet. The processing solution is used in the present disclosure in a broader sense as encompassing various types of solution ranging from wash liquid, typically water to ordinary processing solutions used in the photographic art, typically developing and bleach-fix solutions. In general, wash liquid favors counter flow and ordinary processing solutions favor parallel flow with respect to the travel direction of the photosensitive sheet.

Figure 1:
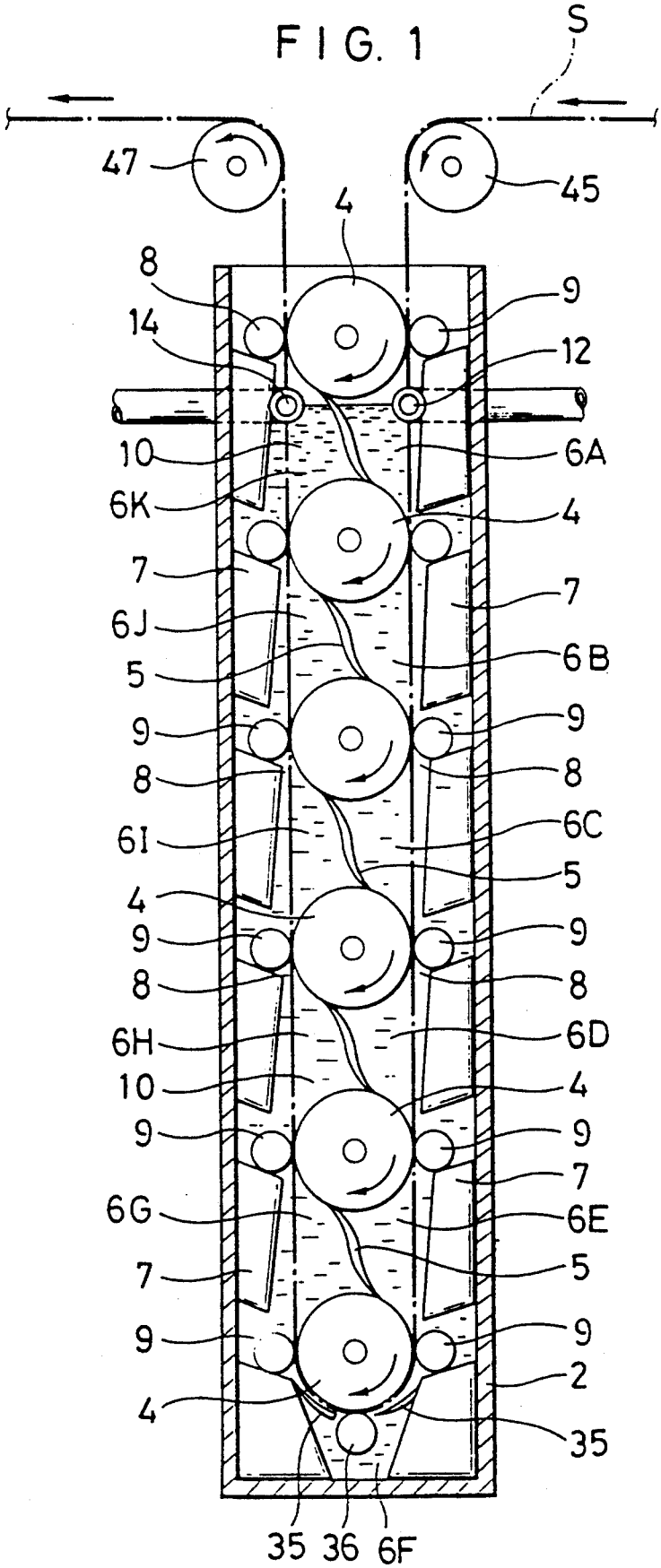
FIG. 1 is a vertical cross section of a processing apparatus according to a first embodiment of the present invention.

Referring to FIG. 1, there is illustrated an apparatus for processing photosensitive material according to one preferred embodiment of the present invention. The apparatus is in the form of a processing tank which is illustrated as comprising a vertical elongated housing 2 which defines an interior chamber. The chamber is divided into a plurality of serially arranged processing compartments 6A through 6K by partition means including main rollers 4 and partitions 5. The compartments are filled with processing solution 10. Photosensitive material is successively passed through the compartments 6A through 6K for processing. The use of the partitioned processing tank permits the photosensitive material to be processed with a less amount of processing solution than would be otherwise required.

The apparatus is described in more detail. For brevity of description, the compartment 6A where the photosensitive material enters the tank is designated a first compartment and the compartment 6K where the photosensitive material exits the tank is designated a last compartment. Disposed above the tank 2 are an entrance roller 45 for carrying the photosensitive material in the form of a sheet or web S into the processing solution 10 in the first compartment 6A and an exit roller 47 for carrying the photosensitive sheet S out of the processing solution from the last compartment 6K.

Disposed in the tank 2 are a plurality of main rollers 4. The main rollers 4 are spaced apart along a vertical centerline of the tank at sufficient intervals to feed the photosensitive sheet S. Some or all of the main rollers 4 are driven for rotation by any desired drive means (not shown).

Disposed between the two adjoining rollers 4 are partitions 5. The partitions 5 each have an upper end in contact with the upper main roller 4 and a lower end in contact with the lower main roller 4. The partitions 5 together with the main rollers 4 laterally divide the tank chamber into two left and right sections. The main rollers 4 and partitions 5 define the processing compartments 6A through 6K with a suitably configured tank inner wall as will be described later.

Although eleven (11) compartments are defined in the chamber of tank 2 in the illustrated embodiment, the number of compartments defined in the tank chamber is not limited. The number of compartments depends on a particular application of the apparatus, but may generally vary from 3 to 19, for example, where the apparatus is utilized as a developing or washing apparatus. The volume of each compartment is not particularly limited although it may be in the range of from about 100 ml to about 5 liters, for example.

The partition 5 provides a boundary between the left and right compartments while it is in sliding contact with the rotating rollers 4. Thus the partition 5 is preferably formed of a material which is durable, undergoes no deformation, expansion or weakening under the action of processing solution, and does not deteriorate processing solution to adversely affect photographic properties. At least tip portions of the partition 5 are preferably formed of resilient material to provide an effective seal. From these points of view, the partition 5 is preferably formed of elastomers such as rubbers and flexible resins.

Disposed below the main roller 4 at the lowest stage are a pair of reverse guides 35 for turning back the incoming photosensitive sheet S from a downward to an upward travel direction. Disposed between the pair of reverse guides 35 is a guide roller 36 in rotating engagement with the main roller 4 for clamping the photosensitive sheet S therebetween.

Figure 2:
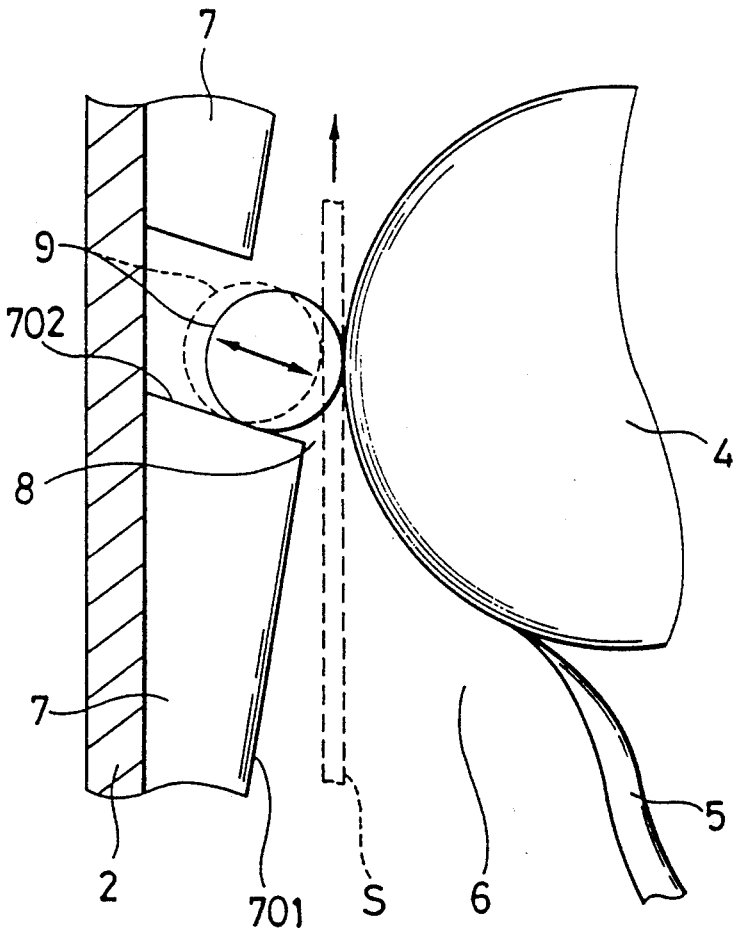
FIG. 2 is an enlarged view of a gate portion of the apparatus of FIG. 1.

For each of the processing compartments 6A to 6K, a guide member 7 is provided on the inner wall of the tank 2. The guide member 7 at its upper end defines with the main roller 4 a gate 8 through which the photosensitive sheet S enters the compartment. More particularly, as best shown in FIG. 2, the guide member 7 which is fixedly secured to the tank wall includes an inside surface 701 which is vertically inclined for smoothly leading the photosensitive sheet S to a subsequent gate 8. The guide member 7 also includes an upper surface 702 which is inclined downward toward the center of the tank for bearing a free roller 9 thereon while biasing it toward the main roller 4. The gate 8 is thus defined between the corner of the guide member 7 between its side and upper surfaces 701 and 702 and the main roller 4.

Shutter means is disposed at the gate 8 for opening and closing the gate. In this embodiment, the shutter means includes the upper inclined surface 702 of the guide member 7 and the free roller 9. The free roller 9 has a diameter larger than the horizontal distance of the gate 8 between the guide member corner and the main roller. The free roller 9 is on the upper inclined surface 702 of the guide member 7 so that it may freely roll thereon. During quiescent periods when no photosensitive sheet S travels, the free roller 9 rolls down the upper inclined surface 702 under gravity into contact with the main roller 4. The free roller 9 comes in rolling engagement with the main roller 4 as shown by a solid line in FIG. 2, closing the gate 8. During operating periods when the photosensitive sheet S travels, the free roller 9 is moved aside along the upper inclined surface 702 by the traveling sheet S. The free roller 9 rolls while clamping the sheet S with the main roller 4 as shown by broken lines in FIG. 2, allowing the sheet S to pass the gate 8. Any desired biasing means such as a spring may be used for biasing the free roller 9 toward the main roller 4 although such means is not shown. It is to be noted that the free roller 9 need not close the gate 8 in complete fluid tight manner, but may allow some flow of processing solution as the photosensitive sheet S passes the gate 8.

The main and free rollers 4 and 9 are preferably formed of a material which is durable, undergoes no deformation, expansion or weakening under the action of processing solution, and does not deteriorate processing solution to adversely affect photographic properties. Preferred examples of such material include rubbers such as neoprene, butadiene, and neoprene-butadiene rubbers, various resins such as polyethylene, polypropylene, ABS resins, polyamides, polyacetal, polyphenylene oxide, polyesters, polyvinyl chloride and phenolic resins, ceramics such as alumina, and corrosion resistant metals such as stainless steel, titanium and its alloys, and Hastelloy, and a mixture thereof. The main and free rollers on the circumference may be subject to various surface treatments.

In the illustrated embodiment, the free roller 9 is moved aside by the photosensitive sheet S reaching and passing there although drive means (not shown) may be provided for positively moving the free roller 9 to controlledly open and close the gate 8.

The shutter means associated with the gate 8 is not limited to the above-illustrated arrangement using the free roller 9. Instead, any shutter arrangement, for example, a squeezer having a movable or resilient member may be employed, optionally in combination with a free roller as mentioned above. Another form of shutter means contemplated herein is a labyrinth structure which permits passage of a photosensitive sheet, but prevents substantial passage of processing solution.

Disposed in proximity to the level of processing solution in the first and last compartments 6A and 6K in an uppermost zone of the tank 2 are inlet and outlet ports 12 and 14 for supplying and discharging processing solution into and out of the tank. Processing solution passes through the compartments in parallel flow with respect to the photosensitive sheet in this embodiment. More particularly, fresh processing solution is fed to the first compartment 6A through the inlet port 12, and exhausted processing solution is discharged from the last compartment 6K through the outlet port 14. The position and number of inlet and outlet ports are not limited to the illustrated embodiment. It would be understood that this arrangement of inlet and outlet ports 12 and 14 is for parallel flow of processing solution with respect to the travel of a photosensitive sheet and that the inlet and outlet ports should be reversed for counter flow of processing solution.

In general, the tank is connected to a source for supplying processing solution to the tank although the source is not shown in the figures. The solution source may be a reservoir which is connected to the inlet port 12 of the tank through a supply conduit and a pump. A discharge conduit is connected to the outlet port 14 of the tank. The pump is actuated to pump fresh solution in the reservoir to the first or upstream compartment of the tank through the supply conduit while exhausted solution is discharged from the last or downstream compartment of the tank to the outside of the tank through the discharge conduit in an overflow manner. Independent of whether the processing solution is wash liquid or developing or bleach-fix solution, the pump is actuated to replenish fresh solution to the tank whenever a photosensitive sheet is processed. For example, whenever a photosensitive sheet is passed, wash liquid is replenished in an amount of about 200 to 500 ml per square meter of photosensitive sheet.

With the above-illustrated arrangement, the photosensitive sheet S is carried into the processing solution 10 in the first compartment 6A of the tank by the entrance roller 45, successively passed through the serially arranged compartments 6A to 6K along a generally U-shaped pathway where it is processed, and finally carried out of the processing solution in the last compartment 6K by the exit roller 47. While the photosensitive sheet S is serially passed through the compartments 6A to 6K, it maintains continuous passage through the processing solution. That is, the photosensitive sheet S is passed through the processing solution in the serially arranged compartments 6A to 6K without contact with the ambient atmosphere.

When the shutter means for selectively closing the gate (see FIGS. 1 and 2) or channel (see FIGS. 3 and 4) between two adjoining compartments is provided, the shutter means allows little fluid communication between the compartments during quiescent periods when no processing is carried out, but allows fluid communication between the compartments during operating periods when photosensitive material is being processed. By the term little fluid communication is meant that the amount of processing solution flowing between two adjoining compartments is as little as substantially negligible. For example, fluid flow is controlled to a flow rate of less than 2 ml/min. or substantially zero. When the shutter means allows fluid communication during operating periods, this fluid communication means a moderate fluid flow which would occur as the solution is displaced by replenishment of fresh solution into a predetermined compartment. For example, processing solution flows at a flow rate of about 1 to about 20 ml/min. It is to be noted that these values are not limitative because the flow rate largely depends on the volume of compartments and the necessary replenishment amount.

Figure 3:
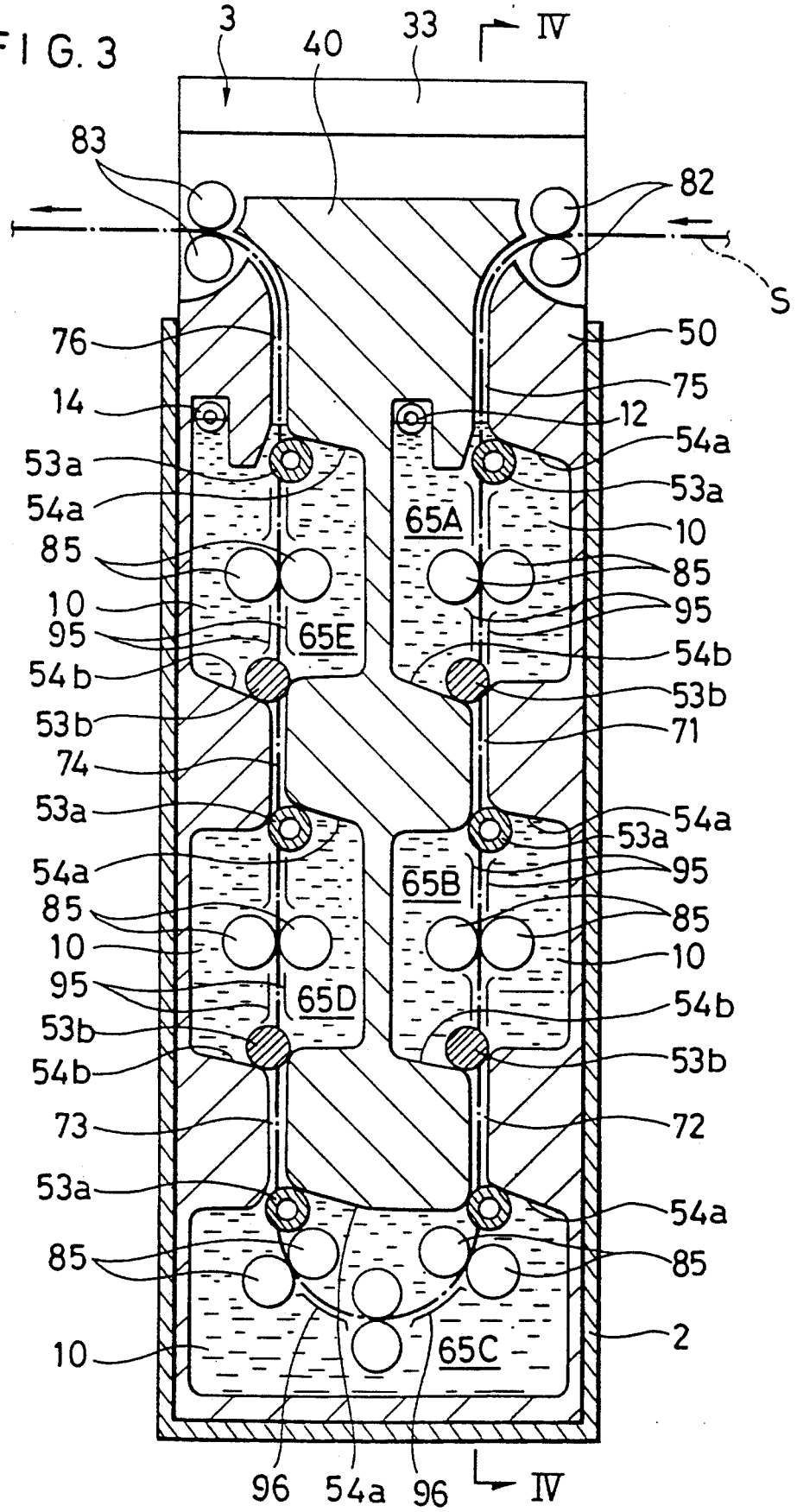
FIG. 3 is a vertical cross section of a processing apparatus according to a second embodiment of the present invention.
Figure 4:
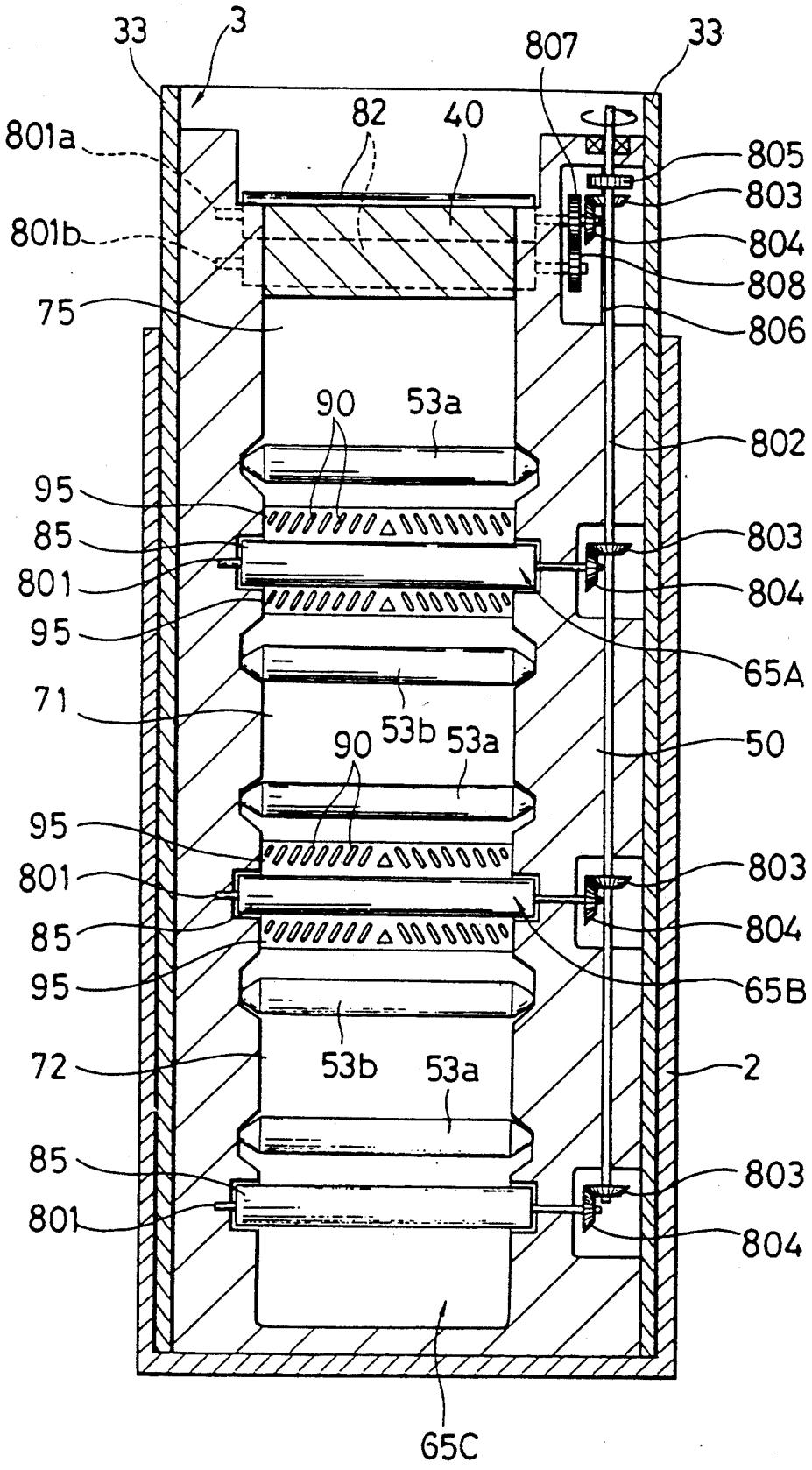
FIG. 4 is a cross section taken along lines IV—IV in FIG. 3.

FIGS. 3 and 4 illustrate a processing tank according to another preferred embodiment of the present invention.

The processing tank is illustrated as comprising a vertical elongated housing 2 and a rack assembly 3 accommodated therein. The rack assembly 3 includes a pair of side plates 33 and blocks 40 and 50 mounted therebetween.

The central block 40 is disposed inside the outer block 50. The blocks 40 and 50 are configured such that when placed in register as shown in FIG. 3, five compartments 65A, 65B, 65C, 65D and 65E are defined therebetween for processing a photosensitive material in the form of a photosensitive sheet or web S. The blocks 40 and 50 placed in register also define narrow channels 71, 72, 73 and 74 between two adjoining compartments 65A and 65B, 65B and 65C, 65C and 65D, and 65D and 65E for fluid communication and sheet passage therebetween. The blocks 40 and 50 further define similar narrow first and last channels 75 and 76 above the compartments 65A and 65E for carrying the photosensitive sheet S into and out of the tank or processing solution.

The blocks 40 and 50 are solid members in the illustrated embodiment, but may be hollow members. They may be formed of resin or other material as long as they can be molded or machined to a relatively complex configuration as shown in the figures.

The breadth or gap distance of the channels 71 to 76 is preferably about 5 to 40 times the thickness of the photosensitive sheet S. The channels of such a breadth allow the photosensitive sheet S to travel therethrough without any disturbance. For facilitated passage, the channels 71 to 76 on the opposed surfaces may be chemically treated to be water repellent or mechanically corrugated.

Disposed approximately at the center in each of the processing compartments 65A, 65B, 65D, and 65E are a pair of feed rollers 85. Three pairs of feed rollers 85 are disposed in the processing compartment 65C at the lowermost stage.

Disposed in proximity to the inlet of the first channel 75 are a pair of entrance rollers 82 for carrying the photosensitive sheet S into the tank or processing solution 10 in the first compartment 65A. Disposed in proximity to the outlet of the last channel 76 are a pair of exit rollers 83 for carrying the photosensitive sheet S out of the tank or processing solution from the last compartment 65E.

These feed rollers 82, 83, and 85 are pivotally supported to the blocks 40 and 50 as shown in FIG. 4. In each of roller pairs, either or both of the rollers in frictional contact with each other are driven for rotation so that the paired rollers can carry the photosensitive sheet S forward while clamping it therebetween.

The drive mechanism for the rollers 82, 83 and 85 is illustrated in FIG. 4. A vertical drive shaft 802 extends through a bore in the side block 50. Bevel gears 803 are fixedly secured to the shaft 802 at predetermined positions. Each of the feed rollers 85 includes a horizontally extending shaft 801 having a bevel gear 804 fixedly secured to one end thereof. The bevel gear 804 on the roller shaft 801 is in mesh with the bevel gear 803 on the drive shaft 802. Then, each feed roller 85 can be rotated by rotating the drive shaft 802 in a predetermined direction by means of a suitable drive such as a motor (not shown).

The entrance rollers 82 also have horizontally extending shafts **801*a* and 801*b* somewhat offset from the drive shaft 802 (the entrance rollers 82 are off the vertical line connecting the feed rollers 85 as seen from FIG. 3). A gear 805 is fixedly secured to the drive shaft 802. A driven shaft 806 is supported parallel to the drive shaft 802 and coupled to the drive shaft 802 through a gear train including the gear 805 on the drive shaft 802. A bevel gear 803 is fixedly secured to the driven shaft 806. Another bevel gear 804 is fixedly secured to the shaft 801*a* of one roller at one end thereof. The bevel gear 804 on the roller shaft 801*a* is in mesh with the bevel gear 803 on the driven shaft 806. The roller shaft 801*a* also has a gear 807 secured thereto inside the bevel gear 804, which is in mesh with a gear 808 secured to the shaft 801*b* of the other roller 82 at one end thereof. Then both the rollers 82 are simultaneously rotated with the rotation of the drive shaft 802**.

For each pair of feed rollers 85 in the processing compartment, one roller is driven for rotation and the other roller is rotated therewith due to frictional engagement between their peripheral surfaces. It is possible to couple the rollers of each pair through gears so that both the rollers are driven for rotation as in the case of the entrance rollers 82.

The rollers may preferably be formed of a material which is durable, undergoes no deformation, expansion or weakening under the action of processing solution, and does not deteriorate processing solution to adversely affect photographic properties. Examples of the roller forming material include various rubbers such as neoprene and EPT rubber; elastomers such as Sunprene (flexible vinyl chloride compound, Mitsubishi Monsanto K.K.), Thermolan, and Hytrel; various resins such as rigid vinyl chloride resin, polypropylene, polyethylene, acrylonitrile-butadiene-styrene (ABS) resin, polyphenylene oxide (PPO), nylon, polyacetal (POM), phenolic resin, silicone resin and Teflon; ceramic materials such as alumina; corrosion resistant metals such as stainless steel, titanium and its alloy and Hastelloy, and a mixture thereof.

Disposed above and below the feed rollers 85 in each of the compartments 65A, 65B, 65D and 65E are two pairs of guide plates 95 for guiding the photosensitive sheet S. Disposed between the feed rollers 85 in the lowest compartment 65C are reverse guides 96 in the form of an arcuate plate for assisting in reversing the travel direction of the photosensitive sheet S.

These guide members 95 and 96 may be of sheet metal or molded plastic material. Often the guide members are formed with perforations 90 distributed approximately uniformly thereon. The perforations 90 in the guide members 95 and 96 allow passage of processing solution therethrough, resulting in promoted circulation of processing solution and increased processing efficiency.

Disposed in proximity to the level of processing solution in the first and last compartments 65A and 65E in an uppermost zone of the tank 2 are inlet and outlet ports 12 and 14 for supplying and discharging processing solution into and out of the tank. Processing solution passes through the compartments in parallel flow with respect to the photosensitive sheet in this embodiment. More particularly, fresh processing solution is fed to the first compartment 65A through the inlet port 12, and exhausted processing solution is discharged from the last compartment 65E through the outlet port 14. It would be understood that this arrangement of inlet and outlet ports 12 and 14 is for parallel flow of processing solution with respect to the travel of a photosensitive sheet and that the inlet and outlet ports should be reversed for counter flow of processing solution. The position and number of inlet and outlet ports are not limited to the illustrated embodiment. For example, the inlet port can be opened in the third compartment 65C at the lowest stage.

Disposed at the transitions between the processing compartments 65A to 65E and the channels 71 to 76 are shutter means for shutting or closing the transitions during quiescent periods when no photosensitive sheet S travels. The shutter means are formed by valves **53*a* and 53*b* in the illustrated embodiment. Both the upper and lower valves 53*a* and 53*b* are in the form of a cylinder or roller having tapered or frustoconical portions at axially opposed ends as shown in FIG. 4**, but they are somewhat different in detail.

The upper valve **53*a* is located adjacent the upper opening of each compartment to the corresponding channel for blocking the opening. To this end, the valve 53*a* is formed to have a lower specific gravity than the processing solution such that the valve may float up due to buoyancy. In contrast, the lower valve 53*b* is located adjacent the lower opening of each compartment to the corresponding channel for blocking the opening. To this end, the valve 53*b*** is formed to have a higher specific gravity than the processing solution such that the valve may sink to the bottom.

The upper and lower valves 53*a* and 53*b* may be given a selected specific gravity by a choice of proper material. When the upper and lower valves 53*a* and 53*b* are solid cylinders, the upper cylinders 53*a* may be formed of foamed plastic material such as expanded polypropylene, expanded PPO, and expanded ABS, and the lower cylinders 53*b* may be formed of rigid plastic material such as rigid polyvinyl chloride, ABS resin and PPO.

It is also possible to form the upper valves 53*a* from a material having a higher specific gravity than the processing solution by molding a hollow cylinder having buoyancy as shown in cross section in FIG. 3. As to the lower valves 53*b*, their overall specific gravity may be increased if desired as by inserting a core of metal or other heavy material (not shown).

From the point of view of providing an improved seal against the channels 71 to 76, it is preferred to form the valve cylinders 53*a* and 53*b* from elastomeric material such as silicone rubber and various other elastomers or to cover the periphery of the valve cylinders 53*a* and 53*b* with such elastomeric material.

Inclined surfaces 54*a* and 54*b* are provided on the compartment-defining upper and lower walls of the blocks 40 and 50. The upper surface 54*a* is upwardly inclined toward the opening of each compartment to the channels. The lower surface 54*b* is downwardly inclined toward the opening of each compartment to the channels.

These valves 53*a* and 53*b* block the access openings of the compartments to the channels 71 to 76 during quiescent periods when no photosensitive sheet S travels, but allow passage of photosensitive sheet S when they are moved aside by the incoming photosensitive sheet S to tumble along the inclined surfaces 54*a* and 54*b*. After the photosensitive sheet S has passed, the valves 53*a* and 53*b* resume their original position to block the access openings of the compartments to the channels 71 to 76 again.

The shutter means for normally blocking the openings of the compartments 65A to 65E to the channels, but permitting passage of the photosensitive sheet S is not limited to the illustrated embodiment. There may be employed mechanical shutter means using a movable shutter plate, fluid shutter means using fluid such as paraffin, liquid crystal and oil as disclosed in Japanese Patent Application No. 63-142464, shutter means using magnetic fluid, roller shutter means as disclosed in Japanese Patent Application No. 63-94755, and squeezer shutter means as disclosed in Japanese Patent Application No. 63-94756 as well as other shutter mechanisms using gaskets and labyrinth seals.

With the above-illustrated arrangement, the photosensitive sheet S is carried into the processing solution 10 in the first compartment 65A of the tank by the entrance roller 82, successively passed through the serially arranged compartments 65A to 65E along a generally U-shaped pathway where it is processed, and finally carried out of the processing solution in the last compartment 65E by the exit roller 83. While the photosensitive sheet S is serially passed through the compartments 65A to 65E, it maintains continuous contact with the processing solution. That is, the photosensitive sheet S is passed through the processing solution in the serially arranged compartments 65A to 65E without contact with the ambient atmosphere.

In one application where the apparatus is used as a washing tank, wash liquid is passed through the compartments in counter flow, that is, in a direction opposite to the travel direction of a photosensitive sheet. Counterflow of wash liquid increases washing efficiency and reduces the amount of wash liquid consumed for the desired washing effect. The composition of wash liquid in successive compartments has a gradient such that the freshness of wash liquid is 65E>65D>65C>65B>65A (meaning that wash liquid in compartment 65E is fresher than in compartment 65D and so forth). Such liquid composition gradient contributes to an improvement in washing efficiency. The channels 71 to 74 are narrow enough to prevent unnecessary flow of wash liquid between the adjoining compartments, assisting in maintenance of the gradient.

Figure 5:
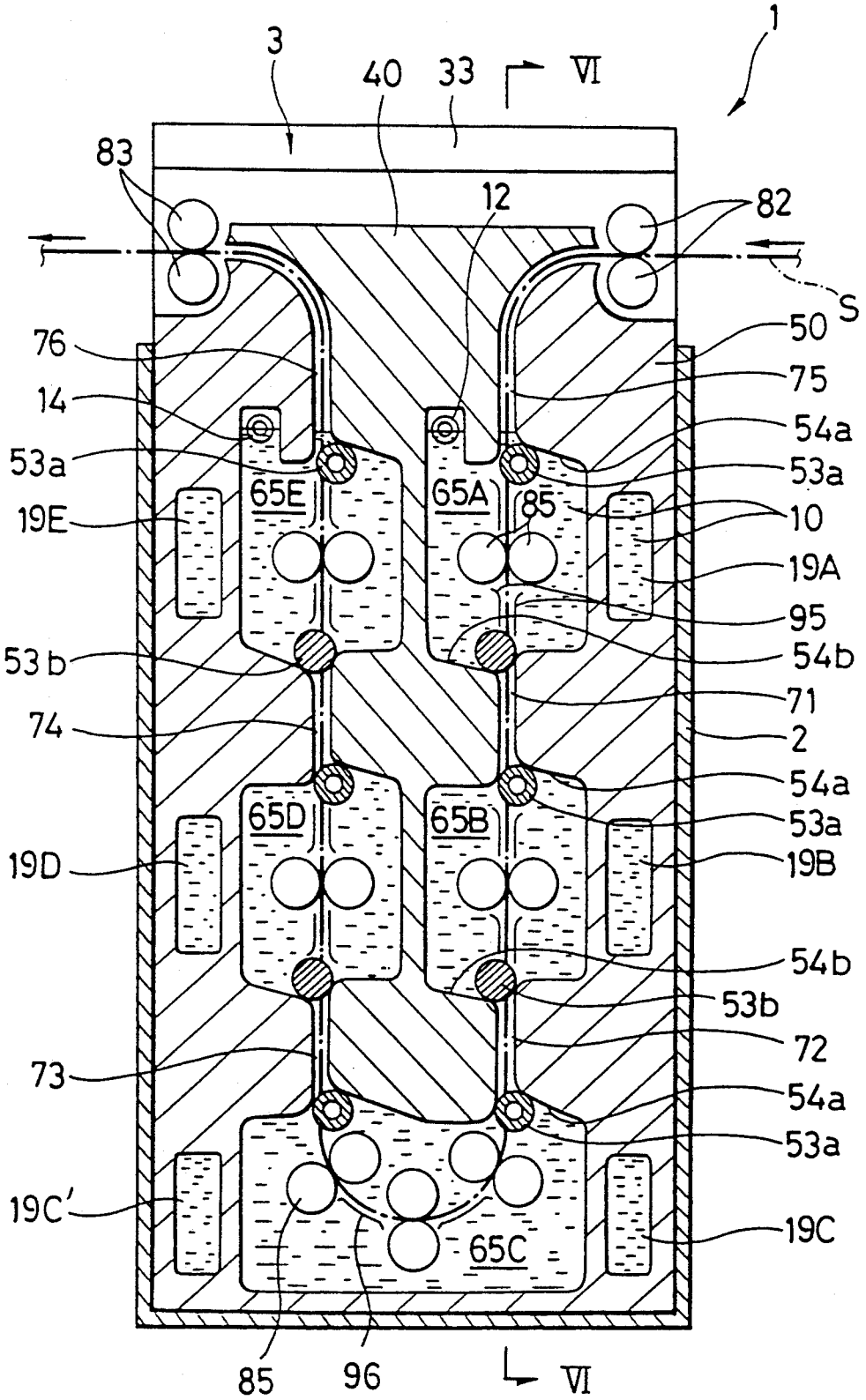
FIG. 5 is a vertical cross section of a processing apparatus according to a third embodiment of the present invention.
Figure 6:
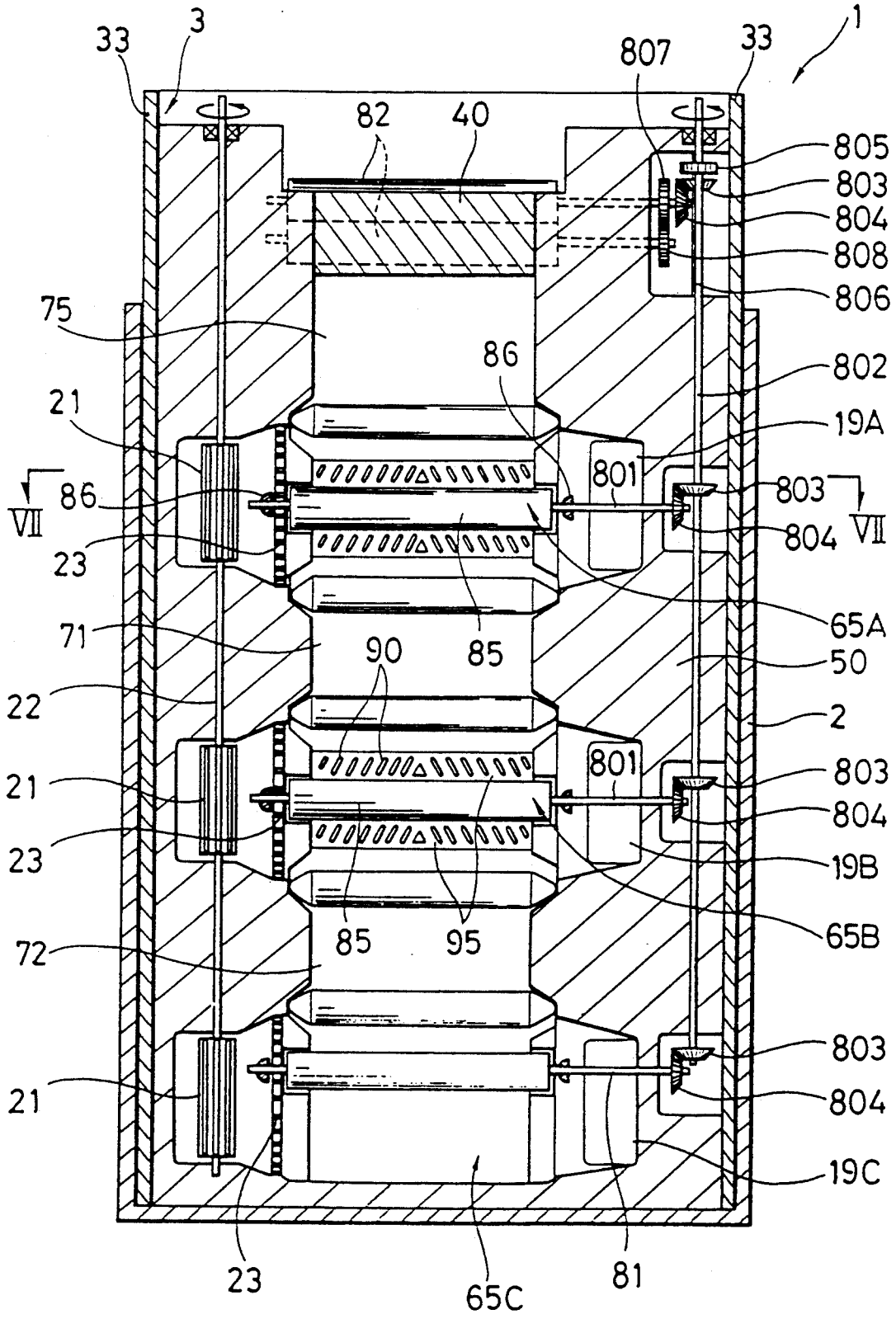
FIG. 6 is a cross section taken along lines VI—VI in FIG. 5.
Figure 7:
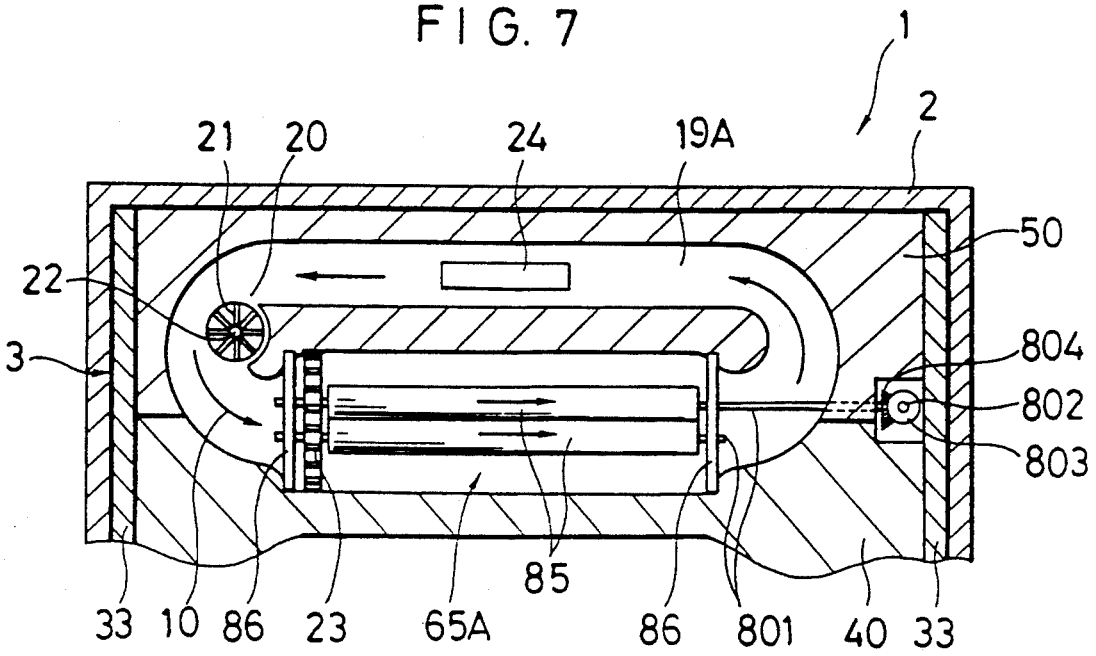
FIG. 7 is a horizontal cross section of fluid circulating means taken along lines VII—VII in FIG. 6.

FIGS. 5, 6 and 7 illustrate a third embodiment of the present invention which is basically the same as the second embodiment shown in FIGS. 3 and 4. The only difference of the third embodiment from the second embodiment is the provision of fluid circulating means associated with each of the compartments 65A to 65E.

In the following description, reference is often made to wash liquid as one example of the processing solution used in the tank. It is to be noted that wash liquid is supplied to the last compartment 65E through the port 14 and discharged from the first compartment 65A through the port 12. That is, wash liquid passes through the compartments in counter flow relationship to the travel of the photosensitive sheet S.

As shown in FIGS. 5, 6 and 7, the block 50 is formed with flowpaths 19A to 19E in fluid communication with the compartments 65A to 65E. Since all the flowpaths 19A to 19E are of the same structure, the flowpath 19A corresponding to the first compartment 65A is described below as representative one.

The flowpath 19*a* at the opposed ends is connected to the compartment 65A at the horizontally opposed ends. Thus the flowpath 19*a* completes with the compartment 65A a flow loop along which processing solution circulates as shown by arrows in FIG. 7.

A pump 20 is disposed in the flowpath 19A at any desired location. The pump 20 is illustrated as a Silocco fan or wheel 21. Rotation of the wheel 21 forces processing solution to circulate the flow loop as shown by arrows in FIG. 7.

The wheels 21 in the flowpaths 19A, 19B and 19C on one side are fixedly secured to a common drive shaft 22 which is rotatably supported in a vertical bore in the block 50 through bearings as shown in FIG. 6. These three wheels 21 are simultaneously rotated in the same direction by rotating the drive shaft 22 in a predetermined direction by a drive coupled to the upper end of the drive shaft 22, for example, in the form of a motor (not shown). A similar drive mechanism is provided for the flowpaths 19E, 19D and 19C on the other side.

A rectifier 23 is disposed at the downstream end of the flowpath 19A with respect to the direction of fluid flow. The rectifier 23 including a plurality of plates assembled in grid form helps the processing solution flow transverse to the photosensitive sheet S in parallel to the surfaces thereof without substantial turbulence.

The flow velocity of processing solution in the flow loop is not critical and may vary over a wide range from a low to a high velocity. For example, the flow velocity of washing liquid is preferably set to about 0.03 to about 0.5 m/sec., especially about 0.05 to about 0.2 m/sec.

with increased efficiency of washing the photosensitive sheet S.

A heater 24 is disposed midway of the flowpath 19A for heating the processing solution to an optimum temperature. In the case of washing liquid, it is heated to 25° to 50° C., for example. Temperature control means comprising a temperature sensor and a microcomputer may be provided in order to maintain the processing solution in the compartment 65A at a predetermined temperature although such components are not shown in the figures.

The construction of the flowpath 19A described above is the same for the remaining flowpaths 19B to 19E associated with the compartments 65B to 65E. It is to be noted that the compartment 65C at the lowest stage is connected to two flowpaths 19C and 19C' to form double reverse flow loops for the processing solution.

Numeral 86 designates fittings in the form of a beam for rotatably supporting the shafts 801 of the feed rollers 85.

The fluid circulating means of the above-illustrated construction creates a flow of processing solution in each of the compartments 65A to 65E, resulting in substantially improved efficiency of processing or washing the photosensitive sheet S. Since the solution flows transverse to the photosensitive sheet S, that is, perpendicular to the travel direction of the photosensitive sheet S, the forced flow does not interfere with the substantial separation of one compartment from the adjoining compartment.

In the illustrated embodiment, the fluid circulating means are provided for all the compartments 65A to 65E. It is contemplated to provide some compartments with the fluid circulating means.

It is further possible to vary the flow velocity and/or temperature of the processing solution in the compartments 65A to 65E. In the case of wash liquid, for example, the flow velocity of wash liquid may vary such that 65E<65D≦65C≦65B≦65A (meaning that the flow velocity in compartment 65E is lower than that in compartment 65D, and so forth), resulting in further improved washing efficiency. Similar washing efficiency improvement is expectable by varying the temperature of wash liquid such that 65E<65D≦65C≦65B≦65A (meaning that the temperature in compartment 65E is lower than that in compartment 65D, and so forth). Such flow velocity and temperature controls may be used independently or in combination.

Figure 8:
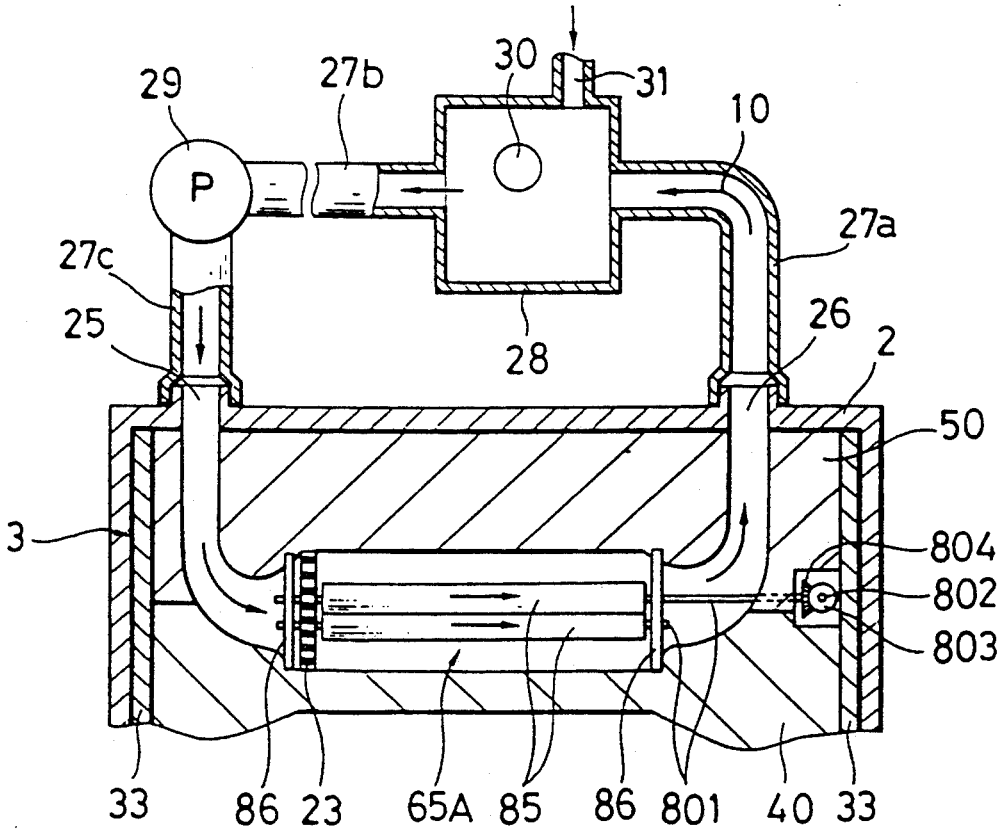
FIG. 8 is a horizontal cross section similar to FIG. 7, showing another example of fluid circulating means.

FIG. 8 shows a modification of the fluid circulating means. The difference from the embodiment of FIG. 7 is that the fluid circulating means is an external circulating system outside the tank 2.

Flow paths in communication with horizontally opposed ends of the compartment 65A extends through the block 50 and the tank wall 2 where inlet and outlet openings 25 and 26 are defined. A first conduit **27*a* is connected at one end to the outlet opening 26 and at the other end to a sump 28. A second conduit 27*b* is connected at one end to the sump 28 and at the other end to a suction port of a pump 29. A third conduit 27*c* is connected at one end to a discharge port of the pump 29 and at the other end to the inlet opening 25**.

A heater 30 is disposed in the sump 28 for heating the processing solution. For example, wash liquid is heated to 25° to 60° C.

The sump 28 is also connected to a conduit 31 for supplying or replenishing fresh processing solution, for example, fresh wash liquid. Such fresh solution may be supplied through the conduit 31 from a reservoir as previously described.

In the circulating system of the above-illustrated construction, actuation of the pump 29 causes wash liquid in the sump 28 to flow a loop connecting the conduit **27*b*, pump 29, conduit 27*c*, inlet opening 25, compartment 65A, outlet opening 26, conduit 27*a* and sump 28 in this order as shown by arrows in FIG. 8**.

The remaining compartments 65B to 65E may be independently provided with the circulating system of the same construction.

For either of the embodiments of FIGS. 7 and 8, the provision of the fluid circulating means has benefits of increased processing efficiency, minimized flow of processing solution between the compartments, and possible maintenance of concentration gradient between the compartments.

Such fluid circulating means may be provided in only one or some or all of the compartments. Usually the processing solution is circulated at a flow rate of about 20 to about 20,000 ml/min.

Although the configured blocks 40 and 50 are mated to define the compartments 65A to 65E in the photosensitive material processing apparatus according to the embodiments shown in FIGS. 3 to 8, the means for dividing the tank chamber into a plurality of compartments is not limited thereto. For example, partitions each in the form of a rigid or resilient member may be suitably combined to partition the tank chamber. In this case, the channels 71 to 76 are not formed.

The transition between two adjoining compartments may be an opening which allows passage of the photosensitive sheet S, but prevents frequent flow of processing solution therethrough, or an opening combined with a squeezer or similar resilient member which allows passage of the photosensitive sheet S, but prevents substantial flow of processing solution therethrough.

The type of photosensitive material which can be processed in the apparatus of the present invention is not particularly limited. Any desired types of photosensitive material may be processed, including color negative films, color reversal films, color photographic paper, color positive films, color reversal photographic paper, printing photographic photosensitive material, radiographic photosensitive material, black-and-white negative films, black-and-white photographic paper, and micro-film photosensitive material.

The processing solution is used in the present invention in a broader sense as encompassing a wide variety of fluid ranging from wash liquid as typified by water to ordinary processing solutions in a common sense in the photographic art, typically developing and bleach-fix solutions.

More particularly, the ordinary processing solutions which can be used in the apparatus of the present invention include developing, fixing, bleaching, and bleach-fix solutions.

One example of the processing solution is developing solutions which include color developing solutions and black-and-white developing solution. The color developing solution is generally an alkaline aqueous solution containing a color developing agent. Examples of the color developing agent include phenylene diamines such as 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hyiroxyethylaniline, 3-methyl-4-amino-N-ethyl-N-β-methanesulfonamideethylaniline, and 4-amino-3-methyl-N-ethyl-N-β-methoxyethylaniline. The color developing solution may contain a pH buffering agent, retarder and antifoggant in addition to the color developing agent. If desired, there may be contained a water softener, preservative, organic solvent, promoter, dye forming coupler, competitive coupler, fogging agent, auxiliary developing agent, thickener, polycarboxylic acid chelating agent, antioxidant, alkali agents, dispersant, surface-active agent, and defoaming agent.

The black-and-white developing solution generally contains a developing agent which may be selected from dihydroxybenzenes such as hydroquinone, 3-pyrazolidones such as 1-phenyl-3-pyrazolidone, aminophenols such as N-methyl-p-aminophenol, alone or a mixture thereof.

The fixing solution used herein are solutions containing fixing agents. The fixing agents for silver halides include ammonium thiosulfate, sodium thiosulfate or hypo, ammonium halides, thiourea, and thioethers.

The bleaching solution used herein are solutions containing bleaching agents. Examples of the bleaching agents include polycarboxylic acid iron salts, potassium ferricyanide, bromates and cobalt hexamine. Preferred among others are potassium ferricyanide, sodium iron (III) ethylenediamine tetraacetate, and ammonium iron (III) ethylenediamine tetraacetate.

Also used herein is a bleach-fix solution which is a solution containing a mixture of bleaching and fixing agents.

The fixing or bleach-fix solution may contain fixing aids, for example, a preservative such as sodium sulfite, acid, buffer agent, and film hardener in addition to the fixing agent. It may also contain a bleach promoter as disclosed in U.S. Pat. Nos. 3,042,520 and 3,241,966, and Japanese Patent Publication (JP-B) Nos. 45-8506 and 45-8636, a thiol compound as disclosed in Japanese Patent Application Kokai (JP-A) No. 53-65732, and any other additives if desired.

Also included is wash liquid. The wash liquid is used in a broad concept as encompassing liquids having washing capability and liquids having stabilizing capability. The wash liquid includes water (including city water, distilled water, and ion exchanged water) which may optionally contain an additive. Examples of the additive used in wash liquid include chelating agents such as inorganic phosphoric acids, aminopolycarboxylic acids, and organic phosphoric acids; bactericides for preventing growth of bacteria and algae; antifungal agents; film hardeners such as magnesium, bismuth, strontium and aluminum salts; and surface-active agents such as nonionic, cationic, anionic and amphoteric surface-active agents and siloxanes. Also useful are compounds as described in L. E. West, "Water Quality Criteria," Phot. Sci. and Eng., Vol. 9, No. 6, 344–359 (1965).

The liquids having stabilizing capability includes liquid having a buffering ability at pH 3–6, liquid containing an aldehyde such as formalin, and liquid containing an antioxidant. There may be contained a brightener, chelating agent, bactericide, fungicide, hardener, surface-active agent, and a mixture thereof if desired.

The photosensitive material processing apparatus of the present invention will find a variety of uses such as wet copying machines, automatic developing machines, printer processors, video printer processors, photographic print producing vending machines, and proof color paper processors.

EXAMPLES

Examples of the present invention are given below by way of illustration and not by way of illustration.

EXAMPLE 1

A multi-layer photographic paper sheet was prepared from a paper support having both sides laminated with polyethylene by coating it with the following coating compositions in the layer arrangement shown below.

The coating composition was prepared as follows.

Preparation of First Layer Coating Composition

In 27.2 ml of ethyl acetate and 7.7 ml (8.0 grams) of high- boiling solvent (Solv-1) were dissolved each 10.2 grams of yellow couplers (ExY-1) and (ExY-2) and 4.4 grams of color image stabilizer (Cpd-1). The solution was dispersed and emulsified in 185 ml of 10% gelatin aqueous solution containing 8 ml of 10% sodium dodecylbenzene sulfonate solution. The emulsified dispersion was mixed with emulsions EM1 and EM2. The resulting solution was adjusted for gelatin concentration so as to give the composition shown below, obtaining a first layer coating composition.

Coating compositions for second to seventh layers were prepared by substantially the same procedure.

The gelatin hardener used in each layer was 1-oxy-3,5-dichloro-s-triazine sodium salt. The thickener used was (Cpd-2).

Layer Arrangement

Each of the layers has the composition shown below. That is, ingredients and their amounts coated are shown below for each layer. The amount of each ingredient coated is expressed in gram per square meter ($g/m^2$) unit except that the amount of silver halide coated is expressed by calculating the amount of silver coated.

Support

Polyethylene laminated paper with the polyethylene layer on the first layer side containing white pigment ($TiO_2$) and a blue-tinting dye.

| | |
|---|---|
| First layer: blue-sensitive layer | |
| Monodispersed silver chlorobromide emulsion (EM1) spectrally sensitized with sensitizing dye (ExS-1) | 0.13 |
| Monodispersed silver chlorobromide emulsion (EM2) spectrally sensitized with sensitizing dye (ExS-1) | 0.13 |
| Gelatin | 1.86 |
| Yellow coupler (ExY-1) | 0.44 |
| Yellow coupler (ExY-2) | 0.39 |
| Color image stabilizer (Cpd-1) | 0.19 |
| Solvent (Solv-1) | 0.35 |
| Second layer: Anti-color mixing layer | |
| Gelatin | 0.99 |
| Anti-color-mixing agent (Cpd-3) | 0.08 |
| Third layer: green-sensitive layer | |
| Monodispersed silver chlorobromide emulsion (EM3) spectrally sensitized with sensitizing dyes (ExS-2) and (ExS-3) | 0.05 |
| Monodispersed silver chlorobromide emulsion (EM4) spectrally sensitized with sensitizing dyes (ExS-2) and (ExS-3) | 0.11 |
| Gelatin | 1.80 |
| Magenta coupler (ExM-1) | 0.39 |
| Color image stabilizer (Cpd-4) | 0.20 |
| Color image stabilizer (Cpd-5) | 0.02 |
| Color image stabilizer (Cpd-6) | 0.03 |
| Solvent (Solv-2) | 0.12 |
| Solvent (Solv-3) | 0.25 |

-continued

| | |
|---|---|
| Fourth layer: UV absorbing layer | |
| Gelatin | 1.60 |
| UV absorbers (Cpd-7/Cpd-8/Cd-9 = 3/2/6 in weight ratio) | 0.70 |
| Anti-color-mixing agent (Cpd-10) | 0.05 |
| Solvent (Solv-4) | 0.27 |
| Fifth layer: red-sensitive layer | |
| Monodispersed silver chlorobromide emulsion (EM5) spectrally sensitized with sensitizing dyes (ExS-4) and (ExS-5) | 0.07 |
| Monodispersed silver chlorobromide emulsion (EM6) spectrally sensitized with sensitizing dyes (ExS-4) and (ExS-5) | 0.16 |
| Gelatin | 0.92 |
| Cyan coupler (ExC-1) | 0.32 |
| Color image stabilizers (Cpd-8/Cpd-9/Cd-12 = 3/4/2 in weight ratio) | 0.17 |
| Dispersing polymer (Cpd-11) | 0.28 |
| Solvent (Solv-2) | 0.20 |
| Sixth layer: UV absorbing layer | |
| Gelatin | 0.54 |
| UV absorbers (Cpd-7/Cpd-9/Cd-12 = 1/5/3 in weight ratio) | 0.21 |
| Solvent (Solv-2) | 0.08 |
| Seventh layer: protective layer | |
| Gelatin | 1.33 |
| Acryl-modified polyvinyl alcohol copolymer (modification 17%) | 0.17 |

-continued

| | |
|---|---|
| Liquid paraffin | 0.03 |

The anti-irradiation dyes used were (Cpd-13) and (Cpd-14). Each photosensitive layer further contained Alkanol B (manufactured by E.I. duPont) and sodium alkylbenzene sulfonate as emulsification/dispersion aids, and succinate ester and Magefacx F-120 (manufactured by Dai-Nihon Ink K.K.) as coating aids. Stabilizers (Cpd-15) and (Cpd-16) were used for stabilizing silver halide.

The emulsions used had the following characteristics.

| Designation | Shape | Grain size (μ) | Br content (mol %) | Coefficient of variation |
|---|---|---|---|---|
| EM1 | cubic | 1.0 | 80 | 0.08 |
| EM2 | cubic | 0.75 | 80 | 0.07 |
| EM3 | cubic | 0.5 | 83 | 0.09 |
| EM4 | cubic | 0.4 | 83 | 0.10 |
| EM5 | cubic | 0.5 | 73 | 0.09 |
| EM6 | cubic | 0.4 | 73 | 0.10 |

The compounds used in this example are identified below.

ExY-1

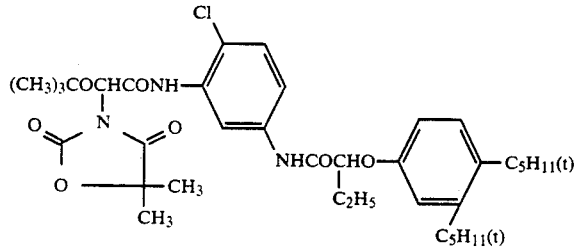

ExY-2

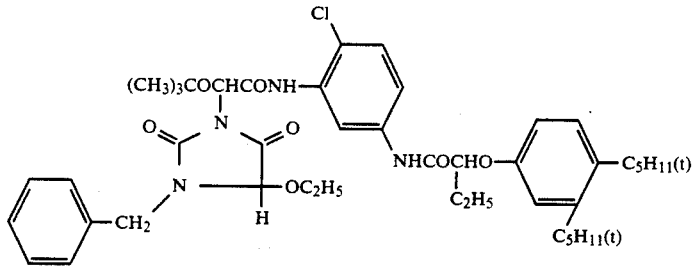

ExM-1

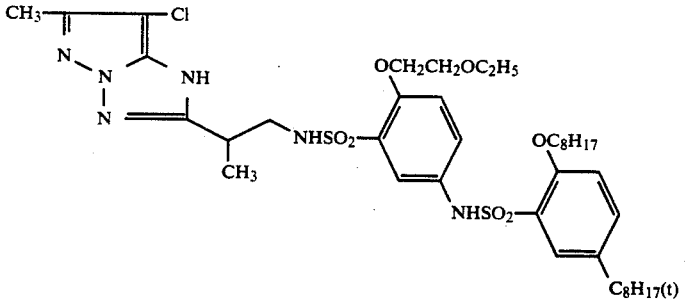

ExC-1

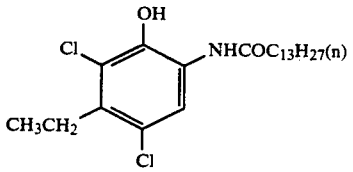

-continued
ExS-1
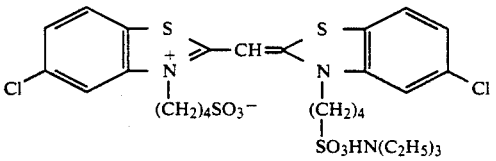
ExS-2
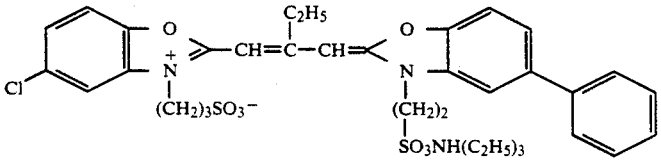
ExS-3
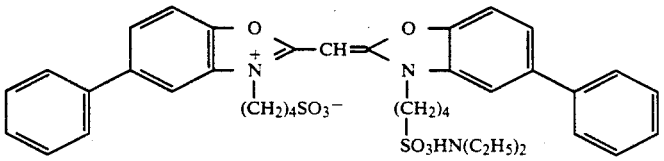
ExS-4
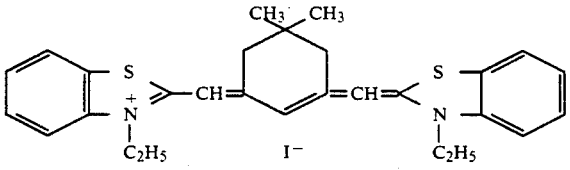
ExS-5
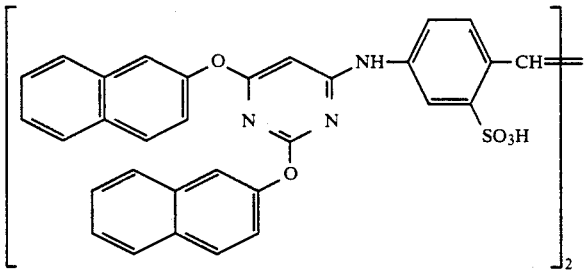
Cpd-1
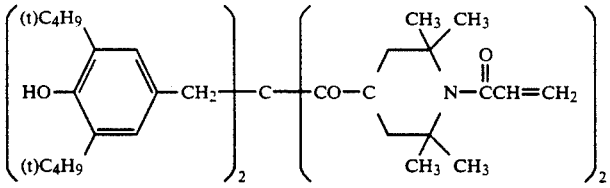
Cpd-2
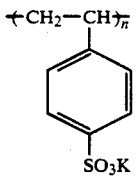
Cpd-3
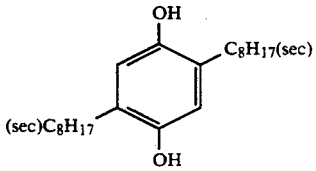

-continued
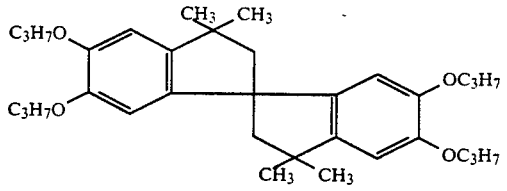
Cpd-4
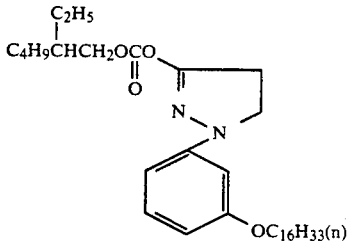
Cpd-5
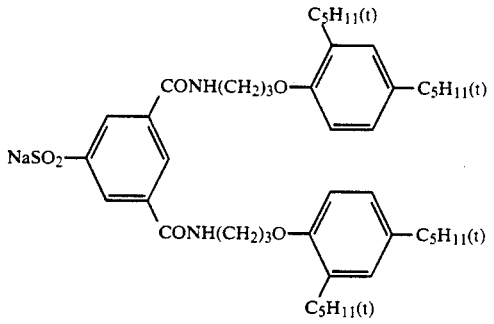
Cpd-6
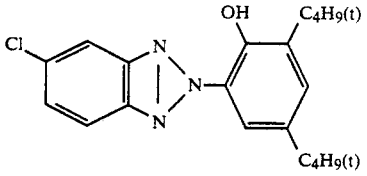
Cpd-7
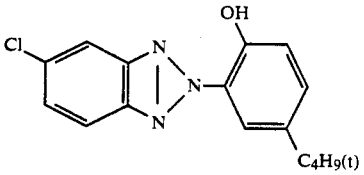
Cpd-8
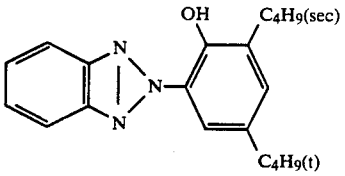
Cpd-9
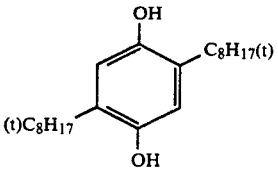
Cpd-10
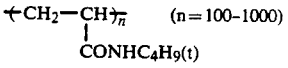
Cpd-11

-continued

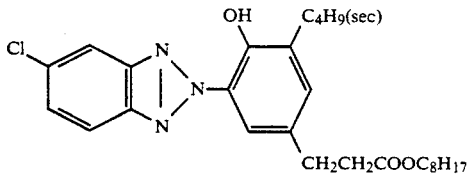

Cpd-12

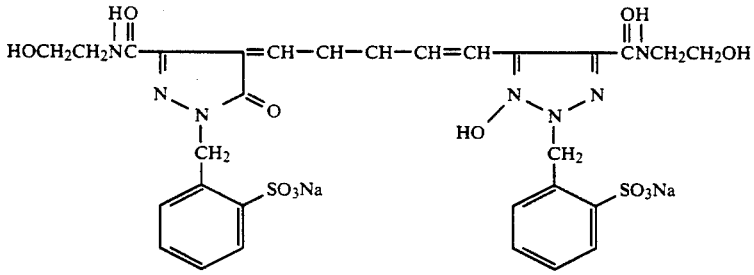

Cpd-13

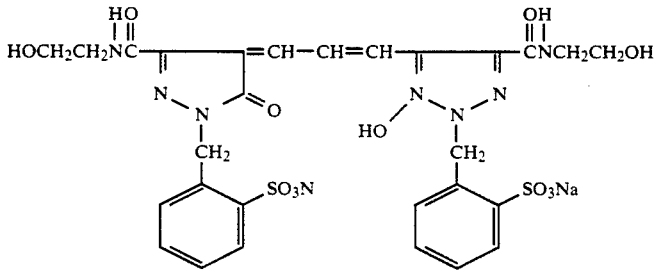

Cpd-14

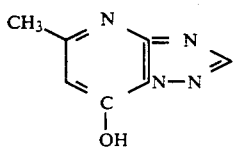

Cpd-15

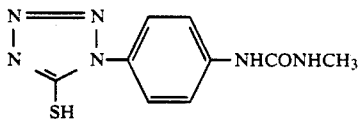

Cpd-16

Solv-1: dibutyl phthalate
Solv-2: tricresyl phosphate
Solv-3: trioctyl phosphate
Solv-4: trinonyl phosphate The above-prepared photosensitive material was exposed imagewise, and then subjected to a running test including a series of continuous steps for color development in the following order.

| Processing steps | Temperature | Time | Replenisher amount* | Volume of Solution in tank |
|---|---|---|---|---|
| Color development | 38° C. | 1'40" | 290 ml | 60 liters |
| Bleach-fix | 35° C. | 60" | 180 ml | 20 liters |
| Rinse (1) | 33-35° C. | 20" | — | 20 liters |
| Rinse (2) | 33-35° C. | 20" | — | 20 liters |
| Rinse (3) | 33-35° C. | 20" | 364 ml | 20 liters |
| Drying | 70-80° C. | 50" | | |

*Volume of solution replenished per square meter of the photosensitive material. For rinsing, wash liquid was passed through three tanks in a counterflow mode from tank (1) to (2) to (3).

Each processing solution had the following composition

| Ingredients | Mother | Replenisher |
|---|---|---|
| Color Developing solution | | |
| Water | 800 ml | 800 ml |
| Diethylene triamine pentaacetate | 1.0 g | 1.0 g |
| Nitrilotriacetate | 2.0 g | 2.0 g |
| 1-hydroxyethylidene-1,1-diphosphonic acid | 2.0 g | 2.0 g |
| Benzyl alcohol | 16 ml | 22 ml |
| Diethylene glycol | 10 ml | 10 ml |
| Sodium sulfite | 2.0 g | 2.5 g |
| Potassium bromide | 0.5 g | — |
| Potassium carbonate | 30 g | 30 g |
| N-ethyl-N-(β-methanesulfonamideethyl)-3-methyl-4-aminoaniline hydrogen sulfate | 5.5 g | 7.5 g |
| Hydroxylamine hydrogen sulfate | 2.0 g | 2.5 g |
| Brightener (WHITEX 4, Sumitomo Chemical K.K.) | 1.5 g | 2.0 g |
| Water totaling to | 1000 ml | 1000 ml |
| pH (25° C.) | 10.20 | 10.60 |
| Bleach-fix solution | | |
| Water | 400 ml | 400 ml |
| Ammonium thiosulfate (70%) | 80 ml | 95 ml |
| Ammonium sulfite | 24 g | 32 g |
| Ammonium iron (III) ethylenediamine tetraacetate | 30 g | 40 g |
| Disodium ethylenediamine tetraacetate | 5 g | 10 g |

-continued

| Ingredients | | Mother | Replenisher |
|---|---|---|---|
| Water | totaling to | 1000 ml | 1000 ml |
| | pH (25° C.) | 6.50 | 6.00 |

Rinsing Liquid

Ion-exchanged water (calcium and magnesium contents each up to 3 ppm)

Procedure A

A modified version of a guide-equipped roll processor FPRP-115, an automatic color paper developing machine manufactured by Fuji Photo Film Co., Ltd., was used. The developing tank could contain 60 liters of developing solution. A running developing test was carried out.

The running conditions were that the tank was heated at an effective temperature for 10 hours a day and 0.2 $m^2$ of photosensitive sheet was processed once a day. This one day cycle was continued over 2 months. The amount of developing solution replenished was 290 $ml/m^2$.

Procedure B

A running developing test was continued for 2 months by the same procedure as Procedure A except that the amount of developing solution replenished was increased 25% to 363 $ml/m^2$.

Procedure C

A running developing test was continued for 2 months by the same procedure as Procedure A except that the modified version of FPRP-115 processor used in Procedure A was further modified. Its developing tank was replaced by a tank of the structure shown in FIGS. 3 and 4. The developing tank had five compartments (65A to 65E) each having a volume of 300 ml. The developing replenisher was introduced into the third compartment (65C) as calculated from the entry of the photosensitive sheet.

A running developing test was continued for 2 months by the same procedure as Procedure C except that the developing replenisher was introduced into the first compartment (65A) and the amount of developing solution replenished was reduced 20% to 232 $ml/m^2$.

For procedures A to D, the photographic performance after 2 months was measured. Green light (GL) sensitivity is selected as a representative photographic characteristic. The final sensitivity is compared with the initial, and the result is expressed in ΔlogE. The results are shown in Table 1.

TABLE 1

| Procedure | Color development: Tank volume | Compartment | Replenisher ($ml/m^2$) | Photographic performance, sensitivity (ΔlogE) |
|---|---|---|---|---|
| A (Prior art) | 60 l | single | 290 | −0.59 |
| B (Prior art) | 60 l | single | 363 | −0.14 |
| C (Invention) | 1.5 l | five | 290 | −0.01 |
| D (Invention) | 1.5 l | five | 232 | −0.02 |

As is evident from Table 1, Procedures C and D according to the present invention successfully maintained the photographic performance high without increasing the amount of developing solution replenished. Procedure D where the replenisher was introduced into the desired compartment was successful in maintaining high photographic performance even though the amount of developing solution replenished was reduced.

EXAMPLE 2

The overall process was similar to Example 1. This example is a test on bleach-fix step.

Procedure G

A conventional bleach-fix tank containing 20 liters of bleach-fix solution was heated at an effective temperature for 10 hours a day and 0.2 $m^2$ of photosensitive sheet was processed once a day. The bleach-fix solution was replenished in an amount of 200 $ml/m^2$ every time when the photosensitive sheet was processed. This cycle was continued over 2 months.

Procedure H

A bleach-fix tank of the structure shown in FIG. 1 was used instead of the conventional bleach-fix tank of Procedure G. This tank included eleven compartments each having a volume of 140 ml. The bleach-fix solution was replenished to the third compartment in an amount of 160 $ml/m^2$ every time when the photosensitive sheet was processed. This cycle was continued over 2 months.

Evaluation was made at the end of 2-month operation. In Procedure G, a noticeable amount of deposit settled in the bleach-fix tank and bleach fog like stains were observed on the processed photosensitive sheet. In Procedure H, no deposit settled and no stain occurred.

EXAMPLE 3

Procedure J

The photosensitive material used was a color negative film commercially available as Fuji Color Negative Super HR100 from Fuji Photo Film Co., Ltd. The film was subjected to sensitometric exposure at 2500 lux for 1/100 second by exposing under a tungsten lamp through a filter at an adjusted color temperature of 4800° K. The exposed film was subjected to type processing using a color negative film processor FP-350 of Mini-Labo Champion 23S manufactured by Fuji Photo Film Co., Ltd.

The processing procedure is described below.

The processing solutions used were a developing solution, a bleaching solution, and a bleach-fix solution available under the trade name of Color Negative Film Processing Agent CN-16Q from Fuji Photo Film Co., Ltd. Wash water and stabilizing solution had the following formulation.

The crossover times between washing tanks and between the washing tank and the stabilizing tank were each 20 seconds.

| Processing steps | Temoerature | Time | Replenisher amount* |
|---|---|---|---|
| Color development | 38.0 + 0.2° C. | 3'15" | 45 ml |
| Bleach | 35–41° C. | 1' | 20 ml |
| Bleach-fix | 35–41° C. | 3'15" | 30 ml |
| Washing (1) | 32–38° C. | 50" | — |
| Washing (2) | 32–38° C. | 50" | 30 ml |
| Stabilizing | 32–41° C. | 40" | 20 ml |

*The amount of solution replenished per 135-size, 24-frame roll film.

Washing was carried out by a two stage cascade flow method wherein wash water was passed in a counter flow relationship to the travel direction of the film.

Processing Solution Formulation Washing Water

Ion exchanged water

| Stabilizing solution | | |
|---|---|---|
| Formalin (37%) | | 2.0 ml |
| Polyoxyethylene-p-monononylphenyl ether (average degree of polymerization 10) | | 0.3 g |
| Disodium ethylenediamine tetraacetate | | 0.05 g |
| Water | totaling to | 1000 ml |
| | pH | 5.0–8.0 |

The replenisher is the same as the mother solution.

Procedure K

Procedure J was repeated except that the washing and stabilizing tanks were replaced by a washing tank of the structure shown in FIG. 1 which was filled with ion exchanged water. The washing time was set to 140 seconds.

The washing tank included nine compartments each having a volume of 120 ml. The tank design was such that wash liquid mobility between compartments was about 0.2 ml/min. during quiescent periods and about 15 ml/min. during processing periods when the film was being processed or washed.

Wash liquid was passed in a counter flow relationship with respect to the travel direction of the film.

For Procedures J and K, the amount of wash water replenished per 135-size, 24-frame roll film was compared.

In the first washing tank (or first compartment) and the stabilizing tank (or last compartment), the electric conductivity was measured to determine the concentration of the ingredients carried over from the fixing tank. The ratio of concentration in first tank (or first compartment) to concentration in stabilizing tank (or last compartment) is reported as concentration ratio. The crossover time for Procedure J is the sum of the crossover time between the first and second washing tanks and that between the second washing tank and the stabilizing tank.

The results are shown in Table 2.

TABLE 2

| | J (Prior art) | K (Invention) |
|---|---|---|
| Tank number | 3 | 1 |
| Tank volume | 4200 ml | 120 ml × 9 |
| Crossover time | 40 sec. | — |
| Wash water tank | 2 | 1 |
| Wash water replenishment | 30 ml | 20 ml |
| Stabilizer tank | 1 | — |
| Stabilizer replenishment | 20 ml | — |
| Total replenishment | 50 ml | 20 ml |
| Concentration ratio | $2 \times 10^2$ | $1 \times 10^5$ |

Procedure K which used a less amount of replenisher added gave good photographic performance without a stain which would often occur in the type processing of Procedure J. The space occupied by the washing tank in Procedure K was reduced about 20% as compared with Procedure J.

EXAMPLE 4

Procedure K was repeated except that a washing tank of the structure shown in FIGS. 3 and 4 was used. Similar results were obtained.

The washing tank included seven compartments each having a volume of 260 ml. The tank design was such that wash liquid mobility between compartments was about 0.1 ml/min. during quiescent periods and about 20 ml/min. during processing periods when the film was being processed or washed.

Wash liquid was passed in counter flow. The concentration ratio was found to be $1 \times 10^4$.

EXAMPLE 5

Example 4 was repeated except that a washing tank of the structure shown in FIGS. 5–7 was used. Similar results were obtained.

The tank design was such that wash liquid mobility between compartments was about 1 ml/min. during quiescent periods and about 35 ml/min. during processing periods when the film was being processed or washed.

In each compartment, the pump was actuated to flow wash liquid transverse to the film and parallel to the film surfaces at a flow rate of 1 liter/min.

Wash liquid was passed in counter flow. The concentration ratio was found to be $3 \times 10^3$.

The photosensitive material processing apparatus of the present invention has many benefits including increased processing efficiency, a reduced amount of replenisher added, and a size reduction of processing apparatus. The apparatus permits a photographic image of high quality to be produced with a less amount of processing solution and a less increment of its replenisher.

When the apparatus is used as a washing apparatus, it permits a photographic image of high quality to be produced with a less amount of wash water and a less increment of wash water replenished.

The provision of fluid circulating means capable of flowing processing solution transverse to the photosensitive material being processed significantly increases the processing efficiency of the apparatus. The desired washing effect is achieved with a less amount of wash water within a shorter period of time.

The shutter means can close the channel between the adjoining compartments during quiescent periods. A certain gradient is maintained in solution composition or concentration of the successive compartments. Efficient washing is ensured when washing is restarted. Similar results are expectable for all types of processing as contemplated herein. We have found that better results are obtained when the shutter means in the channel is constructed by a blade, typically a pair of opposed blades. Briefly stated, in a presently preferred embodiment, the apparatus further includes means for restricting substantial movement of the processing fluid between adjacent compartments during quiescent periods when no photosensitive material is passed, but during operating periods when photosensitive material is passed, allowing movement of the fluid between adjacent compartments and breaking any boundary film which can form on the surface of the traveling photosensitive material. Of course, the means allows passage of the photosensitive material.

Figure 9:
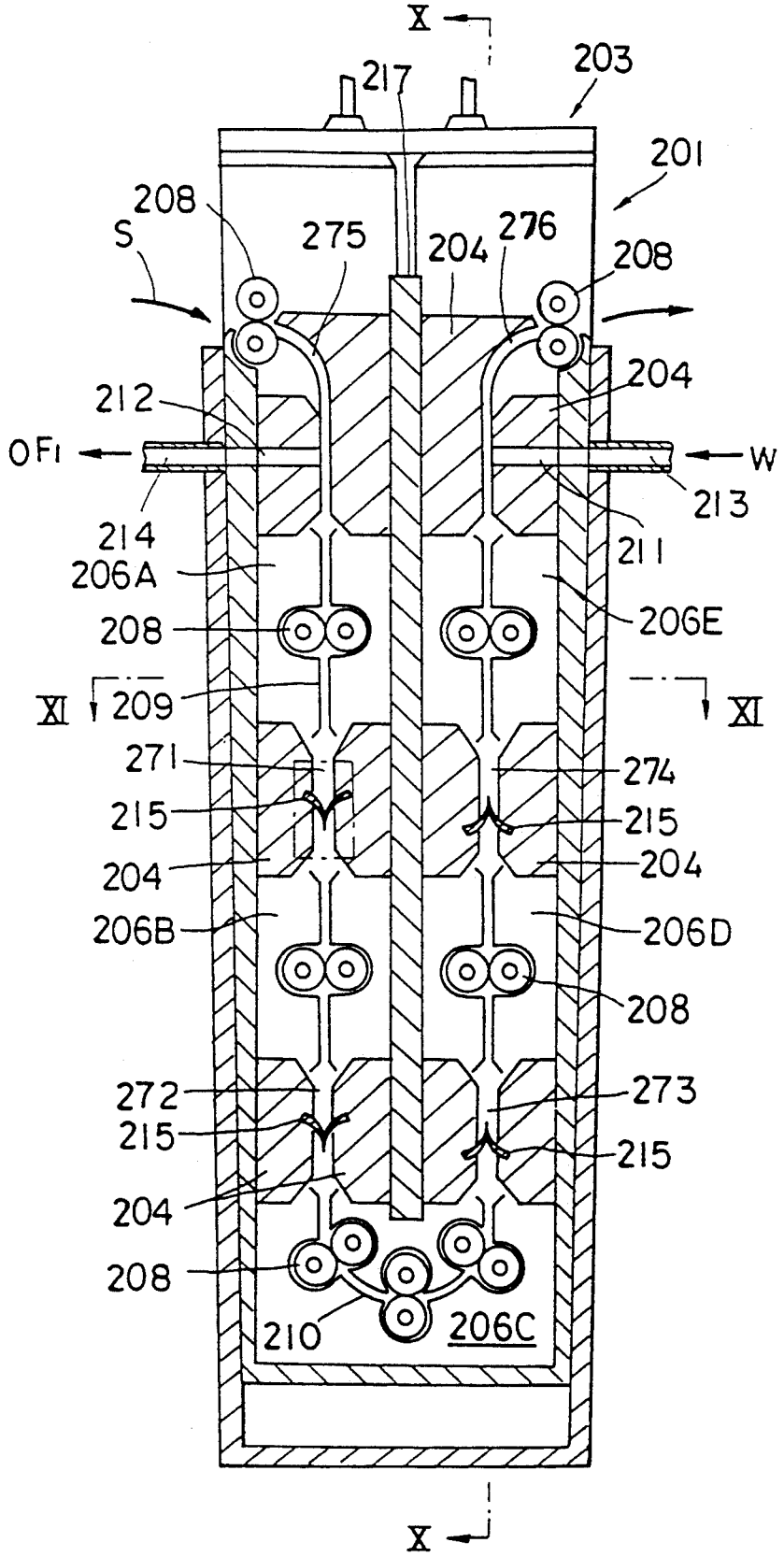
FIG. 9 is a vertical cross section of a processing apparatus according to a further embodiment of the present invention having a pair of blades in each channel.
Figure 10:
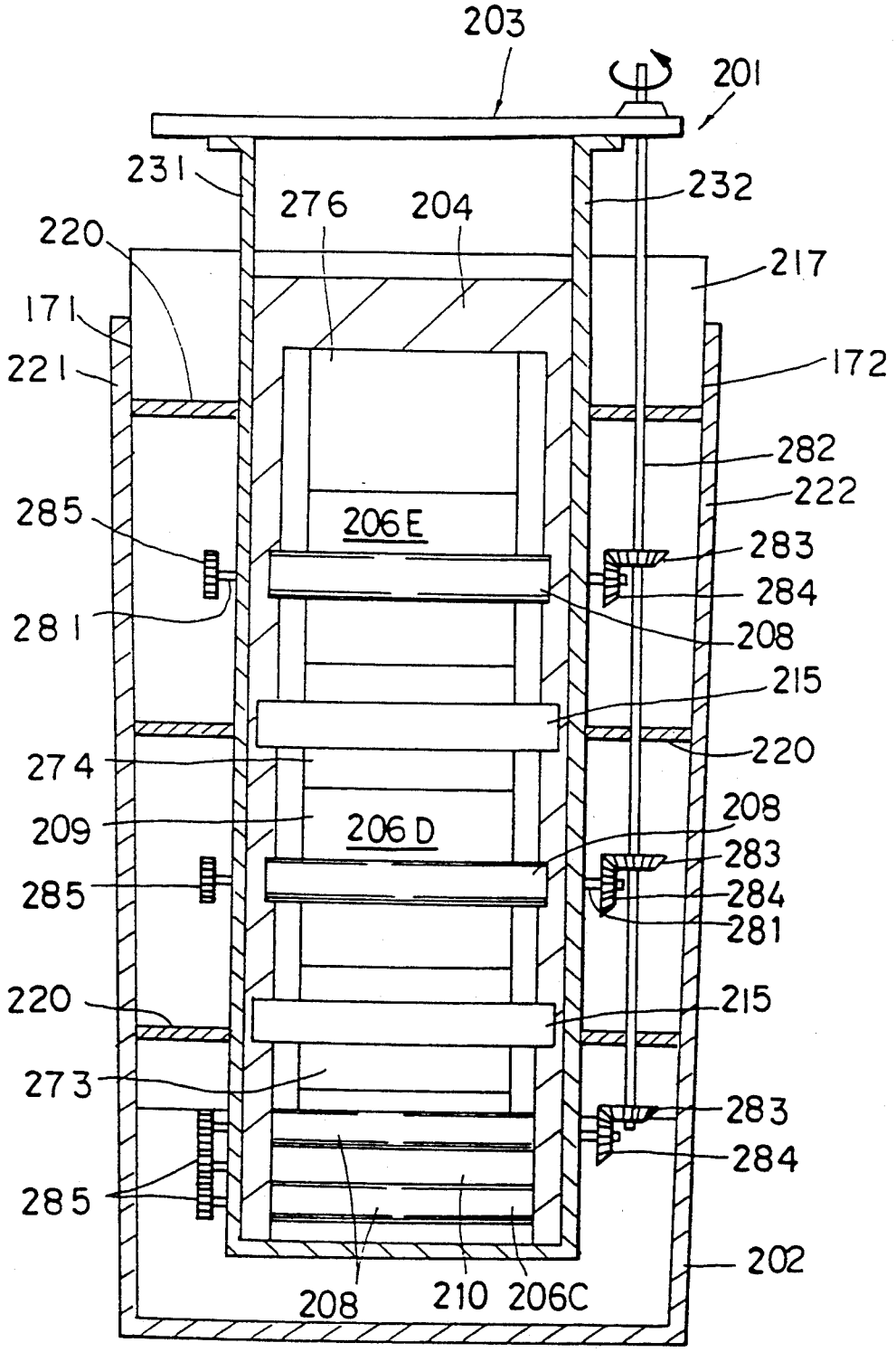
FIG. 10 is a vertical cross section taken along lines X—X in FIG. 9.
Figure 11:
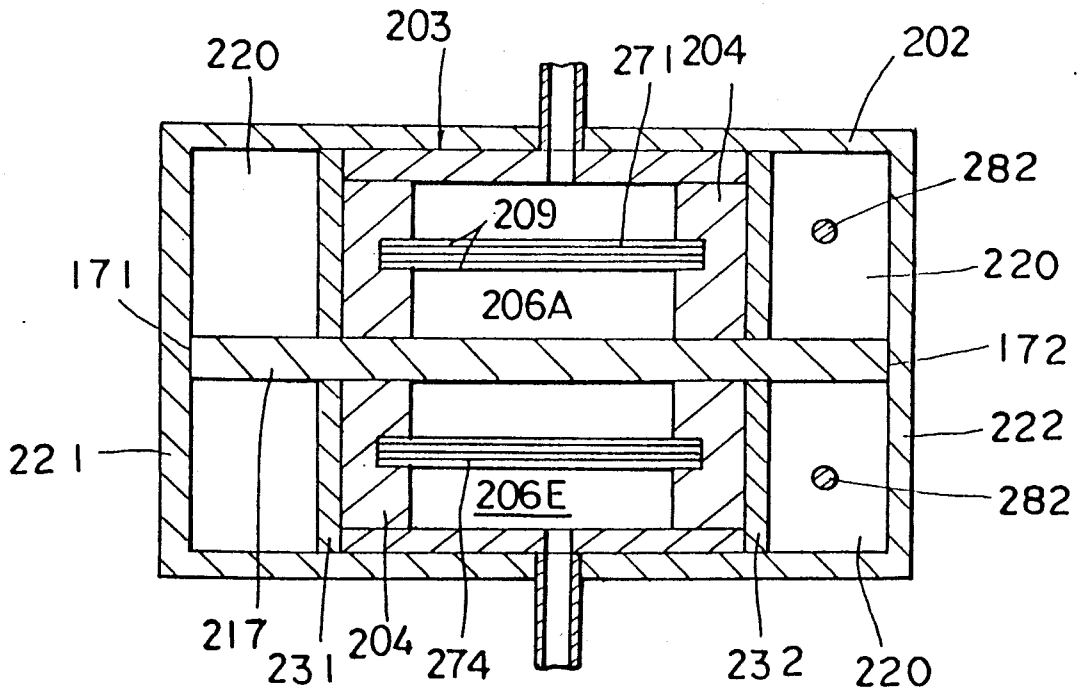
FIG. 11 is a transverse cross section taken along lines XI—XI in FIG. 9.

FIG. 9 is an elevational cross section of a photosensitive material processing apparatus in one embodiment of the invention wherein the apparatus is embodied as a washing unit. FIGS. 10 and 11 are elevational and transverse cross sections of the apparatus taken along lines X—X and XI—XI in FIG. 9, respectively.

The apparatus 201 includes a vertically elongated processing tank 202 of a predetermined volume in which a rack assembly 203 is removably installed. The rack assembly 203 includes side plates 231 and 232 between which a plurality of blocks 204 are disposed. The blocks 204 may be formed of plastic materials such as polyethylene, polypropylene, polyphenylene oxide (PPO), ABS resin, phenolic resin, polyester resin and polyurethane resin, ceramic materials such as alumina, and metallic materials such as stainless steel and titanium. Plastic materials such as polypropylene, PPO, and ABS resin are preferred because of ease of molding, light weight and strength. The blocks 204 are solid in the illustrated embodiment although they may be hollow blocks obtained by blow molding.

The blocks 204 define five compartments or spaces 206A, 206B, 206C, 206D and 206E for washing the photosensitive sheet S with water. The compartments are filled with wash water W. In the illustrated embodiment, each compartment has a volume of about 20 to 3000 ml.

Between pairs of vertically adjoining compartments 206A and 206B, 206B and 206C, 206C and 206D, 206D and 206E are defined narrow channels 271, 272, 273 and 274 for providing flow communication therebetween. Above the compartments 206A and 206E are defined similar channels 275 and 276 for carrying photosensitive sheet S into and out of the tank. The channels 271 to 276 has a breadth or effective slit breadth W (see FIG. 12) of 0.5 to 5 mm which is approximately 4 to 50 times the thickness of photosensitive sheet S and sufficient to ensure smooth travel of photosensitive sheet S therethrough. In the illustrated embodiment, the channels each have a length of about 10 to 200 mm, preferably about 20 to 60 mm.

The compartments 206A to 206E and channels 271 to 276 form a continuous processing path.

In each of the channels 271 to 274 are disposed a pair of blades 215. The pair of blades 215 at one end are secured to the opposed blocks 204 such that their distal ends or tips engage to make close contact when no photosensitive sheet S passes thereacross. When photosensitive sheet S passes thereacross, the blade tips are spread apart by the moving photosensitive sheet S.

Figure 12A:
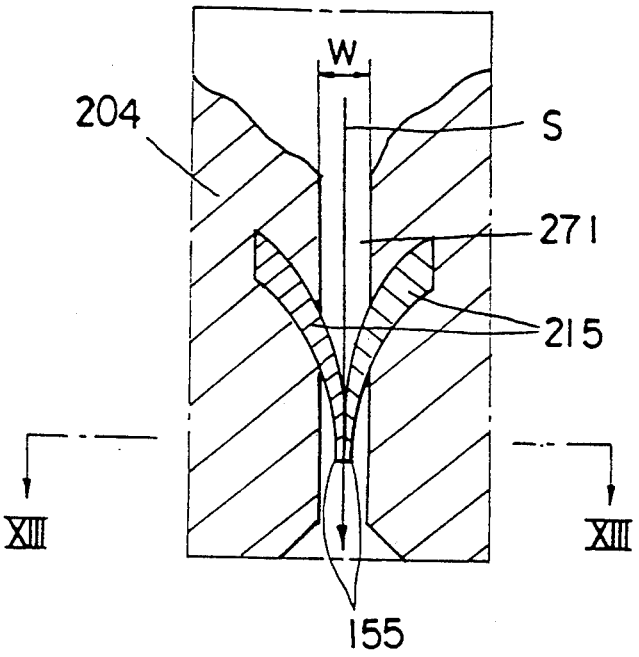
FIGS. 12*a* and 12*b* are enlarged views of a portion encompassed by a phontom rectangle in FIG. 9 showing different examples of the blade pair.
Figure 12B:
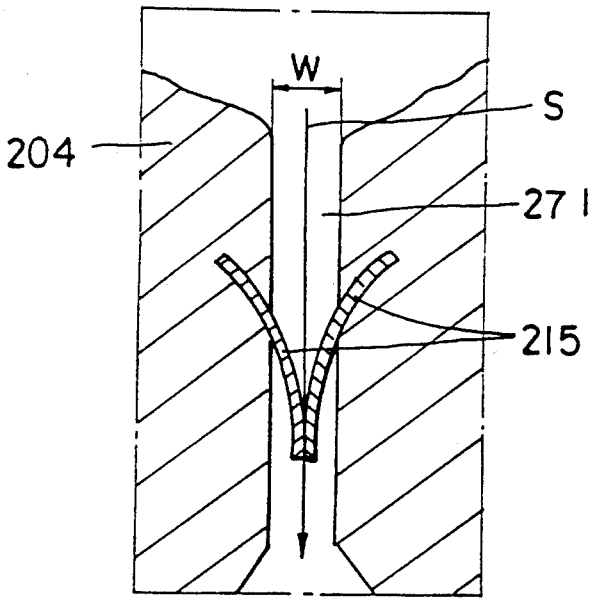

FIG. 12*a* is an enlarged view of a phantom line rectangular portion around the channel 271 in FIG. 9. The blades are wedge-like members tapered from a root to a tip portion and used in pair. Alternatively, as shown in FIG. 12*b*, the blades may be flat members having uniform thickness between the root and the tip.

The blades 215 are preferably provided such that the blade tip is at an average inclination angle of about 30° to 60°, more preferably 30° to 45° relative to the surface of photosensitive sheet S.

The blades 215 including the root for attachment to the blocks 204 have an overall longitudinal length of greater than the effective slit breadth W of the channel 271, preferably 10 to 50 mm which is about 2 to 20 times the channel breadth W, more preferably 15 to 25 mm which is about 3 to 10 times the channel breadth W. In the absence of photosensitive sheet S, the pair of opposed blades 215 make close contact at their tip portion over a vertical distance of about 1 to 10 mm, especially about 2 to 5 mm. The blades 215 have a thickness of at least 1/10 of their length or at least 0.5 mm, more preferably 0.7 to 2 mm, especially 1 to 1.5 mm.

The blades 215 are so sized to ensure that the blades make close contact at their tip portion in the absence of photosensitive sheet S for effectively blocking flow of wash water W, while allowing passage of photosensitive sheet S and flow of wash water W therewith in a small flow rate, but sufficient to provide a necessary replenishing quantity.

Figure 13:
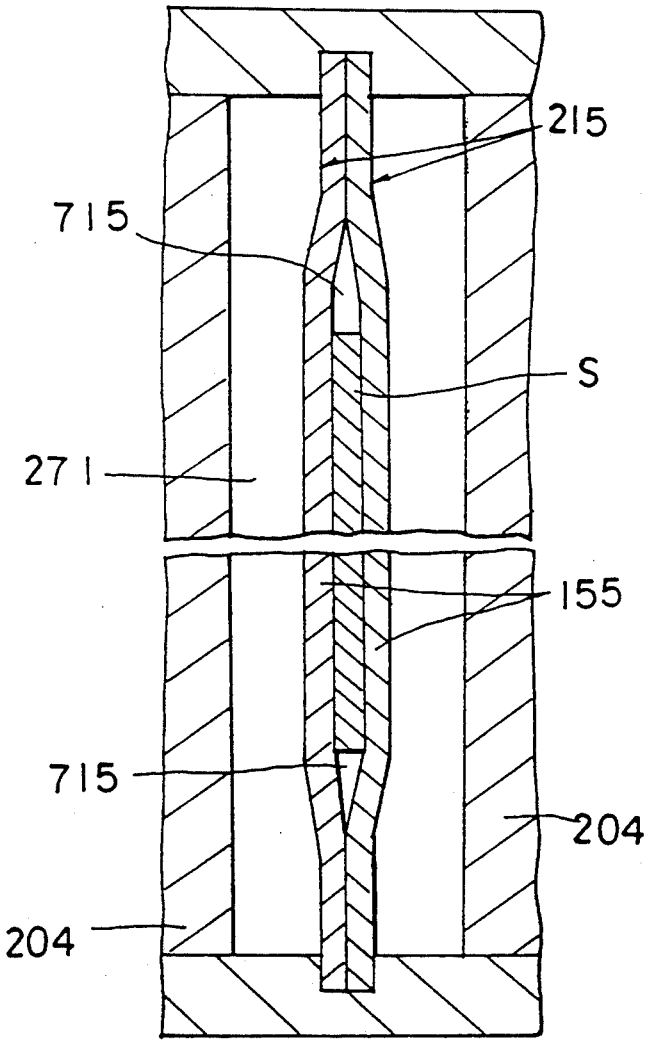
FIG. 13 is a cross section taken along lines XIII—XIII in FIG. 12*a* showing a photosensitive sheet passing between the pair of blades.

FIG. 13 is a cross section of the pair of blades taken along lines XIII—XIII in FIG. 12*a*. When photosensitive sheet S passes through the tank, the entry of photosensitive sheet S between the pair of blades 215 spread the blade tip portions 155 apart in a transverse direction so that a gap 715 is created between the blade tip portions 155 at either lateral edge of photosensitive sheet S. The gaps 715 thus created allow flow of wash water W as mentioned above. The flow rate of wash water may be controlled by a choice of the material of which the blades 215 are made.

The blades 215 are made of elastomeric materials, for example, rubbery materials such as natural rubber, chloroprene rubber, nitrile rubber, butyl rubber, fluorinated rubber, isoprene rubber, butadiene rubber, styrene-butadiene rubber, ethylene-propylene rubber, and silicone rubber, and flexible resins such as flexible polyvinyl chloride, polyethylene, polypropylene, ionomer resin, fluorine resin, and silicone resin. The blade material is not critical insofar as it does not adversely affect wash water, and may be chosen in accordance with the desired replenishing quantity. Silicone rubber is preferred.

Referring to FIGS. 9 and 10 again, a pair of feed rollers 208 are disposed approximately at the center in each of the compartments 206A, 206B, 206D, and 206E. Three pairs of feed rollers 208 are disposed in the lowermost compartment 206C. Disposed in proximity to the inlet of the first channel 275 are a pair of entrance rollers 208. Disposed in proximity to the outlet of the last channel 276 are a pair of exit rollers 208.

These feed rollers 208 are pivotally supported to the side plates 231, 232 as shown in FIG. 9. In each of roller pairs, either or both of the rollers in frictional contact with each other are driven for rotation so that the paired rollers can carry the photosensitive sheet S forward while clamping it therebetween.

The drive mechanism for the rollers 208 is illustrated in FIG. 10. A vertical drive shaft 282 has vertically spaced bevel gears 283 fixedly secured thereto. Each of the feed rollers 208 includes a horizontally extending shaft 281 having a bevel gear 284 fixedly secured to one end thereof. The bevel gear 284 on the roller shaft 281 is in mesh with the bevel gear 283 on the drive shaft 282. Then, each feed roller 208 can be rotated by rotating the drive shaft 282 in a predetermined direction by means of a suitable drive such as a motor (not shown). The roller shafts 281 have gears 285 secured thereto in meshing relation so that rotation of one roller 208 is transmitted to the other roller of the pair.

The rollers 208 may be formed of a material which is durable and chemically resistant against wash water. Examples of the roller-forming material include various rubbers such as neoprene and EPT rubber; elastomers such as Sunprene, Thermolan, and Hytrel; various resins such as rigid vinyl chloride resin, polypropylene, polyethylene, ABS resin, PPO, nylon, POM, phenolic resin, polyphenylene sulfide (PPS), polyether sulfone (PES), polyether ether ketone (PEEK), and Teflon;

ceramic materials such as alumina; corrosion resistant metals such as stainless steel, titanium and its alloy and Hastelloy, and a mixture thereof.

Disposed above and below the feed rollers 208 in each of the compartments 206A, 206B, 206D and 206E are two pairs of guide plates 209 for guiding the photosensitive sheet S. Disposed between the feed rollers 208 in the lowest compartment 206C are reverse guides 210 in the form of an arcuate plate for assisting in reversing the travel direction of the photosensitive sheet S.

These guide members 209 and 210 may be of sheet metal or molded plastic material. Often the guide members are formed with perforations (not shown) distributed approximately uniformly thereon. The perforations in the guide members 209 and 210 allow passage of wash water therethrough, resulting in promoted circulation of wash water and increased washing efficiency.

The guide members 209, 210, feed rollers 208 and their drive system form means for feeding photosensitive sheet S.

Above the compartment 206E and through the block 204 is defined a supply port 211 having one end open and another end in fluid communication with the channel 276. Above the compartment 206A and through the block 204 is defined a discharge port 212 having one end open and another end in fluid communication with the channel 275. The tank 202 includes supply and discharge pipes 213 and 214 extending through its side walls and opening to the tank interior. More particularly, the supply and discharge pipes 213 and 214 are in flow communication with the supply and discharge ports 211 and 212, respectively, when the rack assembly 203 is installed in the tank 202. The supply pipe 213 is effective for supplying or replenishing wash water W and the discharge pipe 214 is for discharging exhausted wash water as an overflow $OF_1$.

Figure 14:
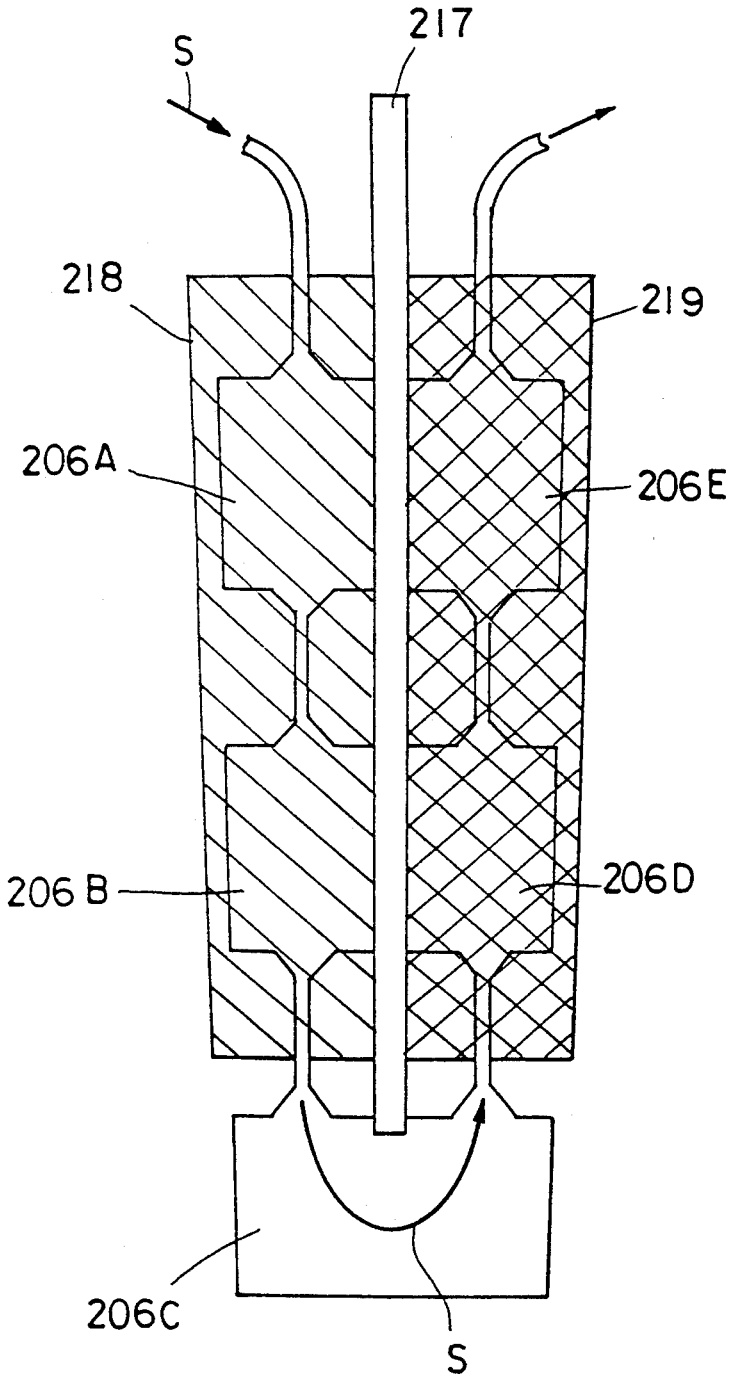
FIG. 14 is a schematic view showing first and second regions in the processing apparatus of FIG. 9.

The rack 203 includes a plate-shaped partition 217. As best shown in FIG. 14, the partition 217 partitions the tank chamber into a first or left singly hatched region 218 and a second or right cross-hatched region 219 for blocking flow communication of wash water W between the regions. The first region 218 includes the first compartment 206A through which photosensitive sheet S initially passes and in the illustrated embodiment, the second compartment 206B through which photosensitive sheet S passes second. The second region 219 includes the last compartment 206E through which photosensitive sheet S finally passes and in the illustrated embodiment, the second last compartment 206D through which photosensitive sheet S passes second last. As seen from FIG. 10, the lateral edges 171, 172 of the partition 217 are tapered toward the bottom and the corresponding side walls 221, 222 of the tank 202 are similarly tapered. When the rack assembly 203 is installed in the tank 202, the partition 217 at the edges 171, 172 abuts the side walls 221, 222 of the tank 202 to divide the tank chamber into the first and second regions 218 and 219. Due to the weight of the rack assembly 203 itself, the engagement is in close contact for obstructing substantial flow of wash water W. The engagement including the edges 171, 172 is preferably provided with a seal member such as a gasket of elastomeric material for achieving full blockage of wash water W.

The tapering angle of the partition edges 171, 172 and the tank side walls 221, 222 may be about 2° to 10° relative to a vertical direction. The partition 217 may be formed of the same material as used for the blocks 204 and be integral with or separate from the blocks 204 and side plates 231, 232.

Outside the side plates 231, 232 and at a predetermined vertical position of the rack assembly 203 are disposed horizontal plates 220 which extend perpendicular to the side plates 231, 232 and partition 217. The shaft 282 extends through the plates 220 and is supported thereby. The plates 220 are located at positions corresponding to the channels 271 to 274. The plates 220 are effective for blocking vertical flow of wash water between the side plates 231, 232 and the side walls 221, 222, thus preventing wash water portions in the compartments 206A to 206E from mixing together outside the side plates 231, 232.

It is now described hot to use and operate the photosensitive material processing apparatus 201 described above.

At the start of processing of photosensitive sheet S, wash water W is fed through supply pipe 213 until all compartments 206A to 206E and narrow channels 271 to 274 are filled with wash water W. Since in the absence of photosensitive sheet S, blades 215 are in close contact to block passage of wash water, it is preferred to transport a sheet substitute instead of photosensitive sheet S through the path to allow for passage of wash water. It is also possible to provide each of compartments 206A to 206E with a supply port to introduce wash water into the compartments independently.

With the compartments filled with wash water W, a photosensitive sheet S is carried into the wash water W in channel 275 above compartment 206A, and the replenishment of wash water W through supply pipe 213 is started. The reason why the replenishment of wash water W through supply pipe 213 is started at the same time as the processing of photosensitive sheet S is started is that since blades 215 provide enhanced blockage of wash water flow, a substantial flow of wash water W is not allowed prior to the passage of photosensitive sheet S across blades 215. Strictly speaking, even after some wash water is replenished, flow of wash water W is not initiated until the leading edge of photosensitive sheet S reaches channel 274 below compartment 206E. Nevertheless, the problem of back flow of wash water through supply pipe 213 can be avoided in the present invention if replenishment intervals are more frequent (e.g., every 5 to 30 seconds) than usual (e.g, every 30 to 90 seconds) and the amount of wash water replenished is quite small (e.g., an increment of 0.5 to 10 ml) so that the water surface rises only a little until the leading edge of photosensitive sheet S reaches the last pair of blades 215.

The invention is mainly intended for the processing of a length of photosensitive material such as a roll of photosensitive paper or in some cases, discrete sheets of photosensitive material having a length of at least 1.3 times, preferably at least 2 times the distance between the adjoining pairs of blades along the continuous path. As a length of photosensitive material S is successively carried through compartments 206A, 206B, 206C, 206D and 206E in this order as shown by arrows in FIG. 9, wash water W establishes a steady flow upon every replenishment of wash water and in a direction opposite to the travel direction of photosensitive sheet S (counter flow) after the leading edge of photosensitive sheet S has passed the last pair of blades 215 in channel 274 below compartment 206E. During the entire duration of processing, intermittent replenishment of wash water is continued to establish intermittent water flow. Exhausted wash water is discharged through discharge pipe 214 as an overflow $OF_1$.

The quantity of wash water passed across blades 215 between two adjoining compartments is preferably 0.1 to 100 ml/min., more preferably 0.5 to 50 ml/min. which is substantially coincident with the quantity of wash water replenished. It is to be noted that photosensitive sheet S is fed at a linear speed of about 0.3 to 20 m/min.

It will be understood that photosensitive sheet S carries some chemical agents such as fixing agents from the preceding bath into wash water W. The concentration of such chemical agent in wash water W is highest in the first compartment 206A and gradually decreases in compartments 206B, 206C, 206D and 206E in this order. This is because blades 215 provide squeeze effect to minimize the drag-out from a certain compartment to the following one, blades 215 act like check valves for providing enhanced blockage of water flow except water flow forced by the replenishment of wash water, and wash water W is replenished in counter flow. Provided that compartments 206A, 206B, 206C, 206D and 206E have concentrations of fixing agent C1, C2, C3, C4 and C5, respectively, in the equilibrium state of running operation, the following relationship is established.

$C2/C1 = 0.1$ to $0.7$
$C3/C1 = 0.01$ to $0.5$
$C4/C1 = 0.001$ to $0.3$
$C5/C1 = 0.0001$ to $0.24$

This tendency is also found with other chemical agents.

Figure 19:
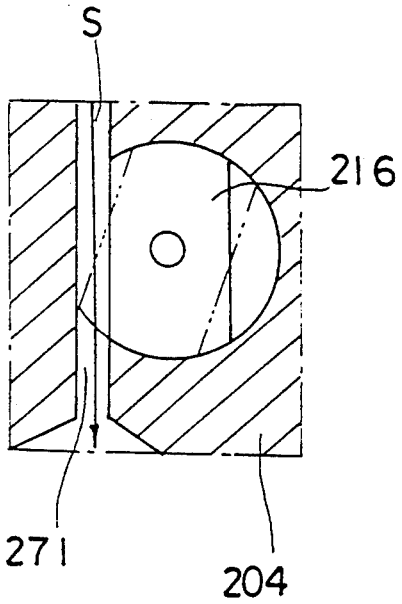
FIG. 19 is a cross sectional view of a rotary shutter.

The squeezing of blades 215 is also effective in reducing the flow of wash water W between the compartments, for example, by about 10 to 70% per square meter of the photosensitive sheet as compared with rotary type blocking means as shown in FIG. 19.

The blades 215 are also effective in breaking a boundary film which will be formed on the emulsion surface of photosensitive sheet S by used and waste substances washed out with wash water because blades 215 make physical contact with the emulsion surface. This promotes water washing, resulting in improved water washing efficiency. More specifically, oil-soluble substances such as residual developing agents are fully washed out from color photosensitive materials.

Replenishment of wash water is terminated at the end of processing, that is, when photosensitive sheet S at the trailing edge is carried out of wash water W through channel 276 above compartment 206E.

At the end of processing, that is, for some time (e.g., 10 to 100 minutes) after photosensitive sheet S is carried out of tank 202, wash water W flows across blades 215 only at a flow rate of 0.0001 to 0.5 ml/min., preferably 0.001 to 0.1 ml/min. in the wash water replenishment direction. The concentrations in the respective compartments of a chemical agent carried in from the preceding bath, for example, fixing agent assume the same relationship as that during processing. The concentration of a chemical agent in a compartment is an indication of contamination of wash water therein.

As mentioned above, blades 215 are effective for blocking water flow during quiescent periods, but effective for allowing limited water flow in the same direction as the replenishment direction and breaking a boundary film during operating periods. The flow quantity of wash water W during operating periods is determined by the gaps defined between blades 215 and photosensitive sheet S passing thereacross to spread apart the blades and creation of such gaps is essential to allow for replenishment.

Therefore, the replenishment quantity should be approximately equal to the flow quantity and be determined depending on the width, thickness and travel speed of photosensitive sheet S, as shown in Table 3 for color paper.

TABLE 3

| Photosensitive sheet width | Travel speed | Replenishment (water feed) |
|---|---|---|
| 2.5 mm | 60 cm/min. | 13 ml/min. |
| | 80 cm/min. | 17 ml/min. |
| | 100 cm/min. | 21 ml/min. |
| 27 mm | 60 cm/min. | 19.4 ml/min. |
| | 80 cm/min. | 26 ml/min. |
| | 100 cm/min. | 32.4 ml/min. |
| 51 mm | 60 cm/min. | 23 ml/min. |
| | 80 cm/min. | 31 ml/min. |
| | 100 cm/min. | 38.5 ml/min. |

The replenishment quantity as shown in Table 3 is approximately 50 to 80% of the replenishment quantity used in similar apparatus without blades. The blade means is effective in reducing the replenishment quantity without causing stains due to poor washing and in increasing water washing efficiency, allowing the apparatus to be more compact and efficient.

During quiescent periods when no photosensitive sheet S is passed, wash water W flows from an upper compartment to a lower compartment only at a flow rate of 0.0001 to 0.5 ml/min., preferably 0.001 to 0.1 ml/min. since blades 215 block substantial flow of wash water W. Provided that compartments 206A to 206E have concentrations of fixing agent C1 to C5, respectively, during quiescent periods, the following relationship is established.

$C2/C1 = 0.001$ to $0.2$
$C3/C1 = 10^{-6}$ to $0.04$
$C4/C1 = 10^{-9}$ to $0.008$
$C5/C1 = 10^{-12}$ to $0.0016$

This indicates that intermixing of wash water W between compartments is minimal during quiescent periods. Then, when the apparatus is restarted after a prolonged quiescent period, efficient water washing is expected from the beginning.

Although a length of photosensitive material has been described, the apparatus is applicable to discrete sheets of photosensitive material. Counter flow of wash water is established whenever a sheet passes across pairs of blades 215 in the respective channels. In this way, wash water passes in counter flow along the continuous processing path as a whole. If a discrete sheet is long enough to extend across all the pairs of blades at the same time, the flow rate of wash water is the same as previously mentioned for a length of photosensitive material. If a discrete sheet is short enough to extend across only two or more pairs of blades at the same time, the flow rate of wash water is 0.1 to 100 ml/min., preferably 0.5 to 50 ml/min. where the wash water is allowed to flow. Where wash water does not flow in principle due to blockage of the blades, the flow rate of wash water during replenishment is 0.1 to 100 ml/min., preferably 0.5 to 50 ml/min. The relationship of concentrations of fixing and other chemical agents in the respective compartments is approximately the same as previously mentioned for a length of photosensitive material.

The replenishment may be controlled in timing and quantity by well-known control means and system.

Although a pair of blades 215 are disposed in each of channels 271 to 274 in the illustrated embodiment, each channel may be provided with two or more pairs of blades, typically two to five pairs of blades of the same configuration or in combination of different length. Use of plural pairs of blades provides improved squeeze effect and fluid flow blockage, leading to a further reduction of the replenishment quantity. For example, if the number of blade pairs is increased from one pair to two pairs under identical conditions, the replenishment quantity is reduced by 20 to 30% as compared with that for one pair.

Figure 15:
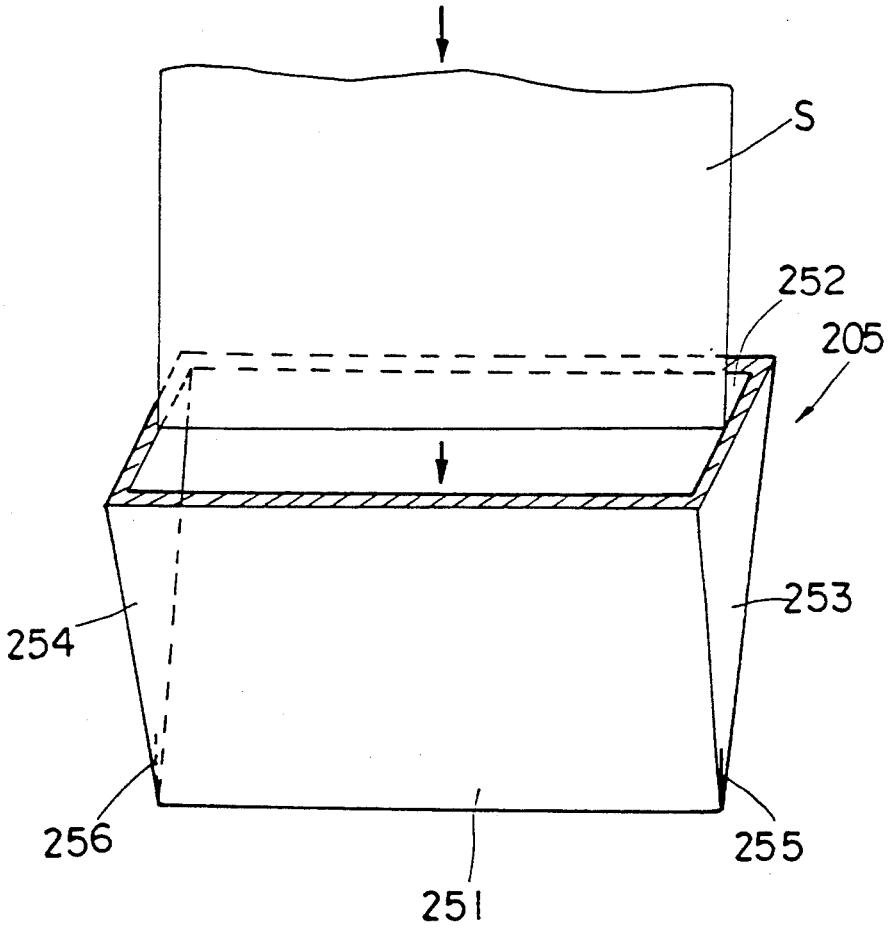
FIG. 15 is a perspective view of an integral blade assembly as another example of the blade means.

Further, a pair of blades are used in a narrow channel in the illustrated embodiment, but the invention is not limited thereto. For example, an integral blade assembly as shown in FIG. 15 may be used. The blade assembly 205 in FIG. 15 may be installed at the same location in the processing tank 202 as the blade pair 215 in FIG. 9. The blade assembly 205 includes a pair of opposed blade members 251, 252 and side members 253, 254 connecting the blade members to form a wedge-shaped assembly. The blade members 251, 252 have lower edges in contact, but not joined together. The side members 253, 254 at the lower end are provided with slits 255, 256, respectively, to allow outward movement of the mating edges of blade members 251, 252. The blade assembly 205 is sized in accordance with the previously described blade pair.

The blade assembly 205 can further reduce the flow of fluid between the tank wall and the photosensitive sheet S as compared with the blade pair under the same conditions, thereby achieving a reduction in replenishment quantity of about 10 to 50%. The concentrations of chemical agent in compartments 206A to 206E are substantially the same as with the blade pair.

The present invention favors the use of a blade pair or integral blade assembly as mentioned above, although a single blade may also be used. A single blade is disposed in a narrow channel so as to block the channel. More particularly, one end or base of the blade is fixedly secured to the channel wall and the other end or tip of the blade is in contact with the opposed channel wall, but allows photosensitive sheet S to pass between the blade tip and the opposed channel wall.

Alternatively, instead of or in addition to the blades, other blocking means may be used for blocking substantial fluid flow during quiescent periods when no photosensitive sheet S is passed. Several different examples of the other blocking means are shown in FIGS. 16*a*, 16*b* and 16*c* as being used in combination with a pair of blades 215.

Figure 16A:
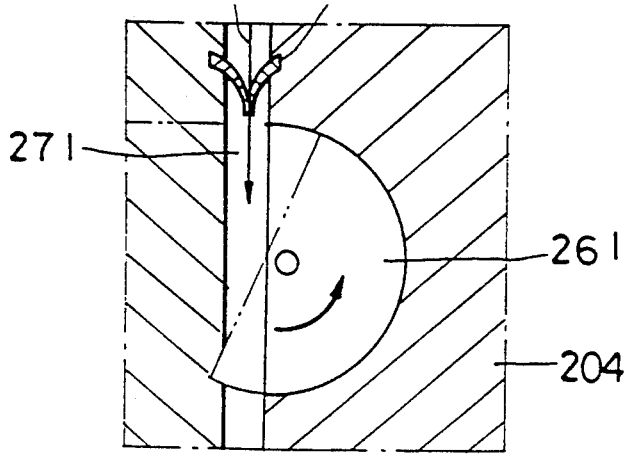
FIGS. 16*a*, 16*b* and 16*c* are cross sections showing different combinations of shutter means.
Figure 16B:
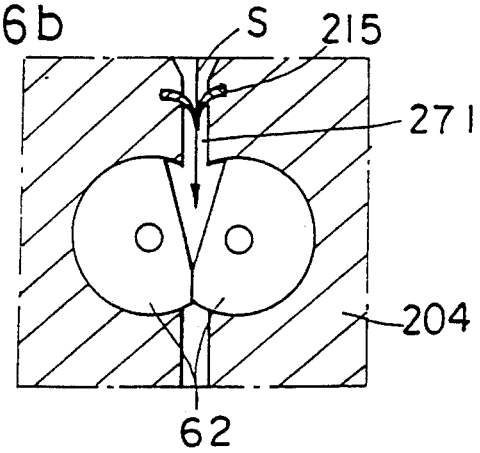
Figure 16C:
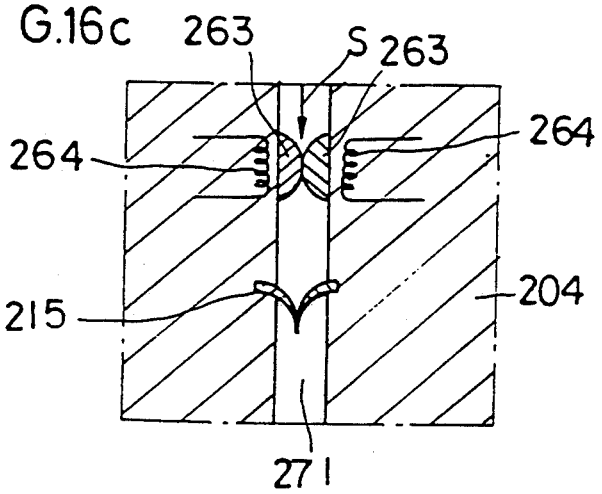

In FIG. 16*a*, a rotary shutter 261 having a semicircular cross section is adapted to rotate for controlling blockage of fluid flow. The blocking means in FIG. 16*b* includes a pair of rotary cylinders having an arcuate cross section. The blocking means in FIG. 16*c* includes a pair of members 263 of shape memory alloy which are controlled for flow and blockage by turning on and off heaters 264 associated with the members. All these blocking means ensure fluid flow blockage by virtue of gravity, clamping force, electromagnetic force or the like during quiescent periods. Upon passage, photosensitive material itself forces away or spreads apart the blocking means while the blocking force is canceled. Control of fluid flow or blockage may be obtained by using a signal indicative of passage of photosensitive sheet S. In response to a passage signal, the blocking means is actuated to allow for passage of fluid and photosensitive sheet S. It is to be noted that FIG. 8 shows typical examples in which the fluid blocking means is provided in the channel 271.

Although fluid replenishment is done at the same time as processing in the above-illustrated embodiments, replenishment may also be done during quiescent periods. A bypass pipe is provided for fluid communication between two adjoining compartments whereby fluid is transferred from an upstream compartment to a subsequent compartment in an amount corresponding to the amount of fluid replenished to the upstream compartment.

The photosensitive material processing apparatus of the present invention has been described as being applied to water washing apparatus although the invention is not limited thereto, but applicable to a variety of processing operations.

When it is desired for the apparatus to carry out stabilization, for example, the apparatus may be of the same construction as the washing apparatus except that it is filled with stabilizing solution instead of wash water. When it is desired for the apparatus to carry out development, bleaching, blix or fixation, the apparatus may be of the construction shown in FIG. 17 wherein the processing solution passes in the same direction as the travel direction of photosensitive sheet S (parallel flow).

Figure 17:
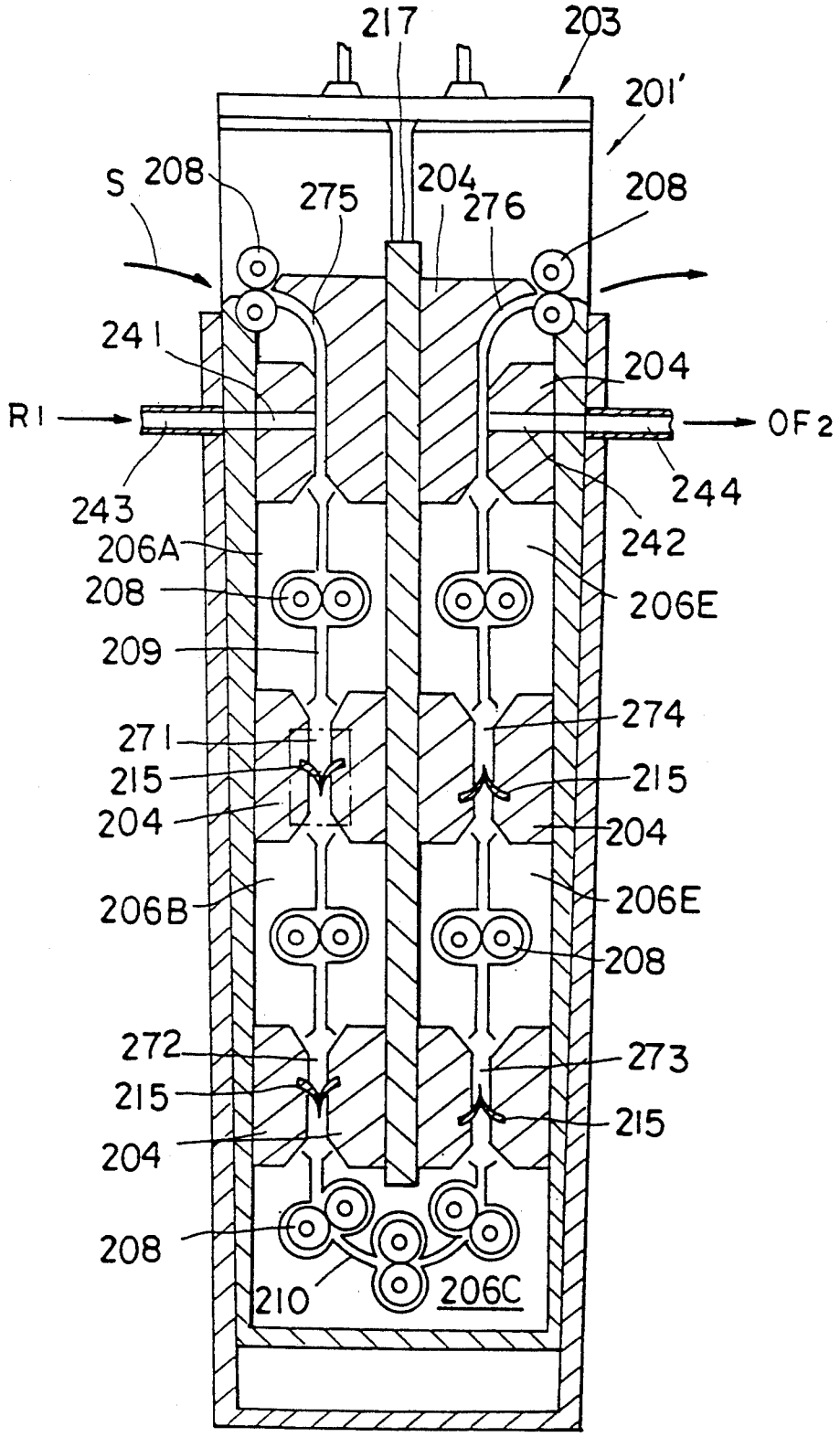
FIG. 17 is a vertical cross section similar to FIG. 9 of a processing apparatus having a pair of blades in each channel, the direction of fluid flow being opposite to that of FIG. 9.

The apparatus 201' shown in FIG. 17 is essentially identical with that of FIG. 9 except that the discharge port 212 and discharge pipe 214 associated with the entrance compartment 206A are used as a supply port 241 and supply pipe 243 and the supply port 211 and supply pipe 213 associated with the exit compartment 206E are used as a discharge port 242 and discharge pipe 244. Therefore, the parts corresponding to those in FIG. 9 are designated by the same reference numerals and their description is omitted.

Where apparatus 201, is used as a color development apparatus, a color developer or its replenisher R1 is supplied into the tank through the supply pipe 243 and discharged through the discharge pipe 244 as an overflow $OF_2$. Replenishment of color developer R1 is started at the same time as the start of processing of photosensitive sheet S, because the blades 215 provide enhanced blockage of color developer against flow and a substantial flow of color developer is enabled only when photosensitive sheet S comes in between the blades 215. Strictly speaking, even after some color developer is replenished, flow of color developer is not initiated until the leading edge of photosensitive sheet S reaches blades 215 in channel 271 below compartment 206A. Nevertheless, the problem of back flow of color developer through supply pipe 243 can be avoided in the present invention if replenishment intervals are more frequent (e.g., every 5 to 30 seconds) than usual (e.g, every 30 to 90 seconds) and the amount of color developer replenished is quite small (e.g., an increment of 0.5 to 10 ml) so that the developer surface rises only a little until the leading edge of photosensitive sheet S reaches the first pair of blades 215.

In this way, photosensitive sheet S passes past compartment 206A and reaches blades 215 in channel 271 as shown by an arrow in FIG. 17. At this point, the fluid flows through blades 215. At the same point, no fluid flow occurs in principle across the remaining blades 215 which photosensitive sheet S has not yet reached, but in practice, the fluid is not completely blocked by a pair of forward or downstream oriented blades when the photosensitive sheet does not pass thereacross. Therefore, in this state, a flow of the fluid in the same direction as the travel direction of photosensitive sheet S (parallel flow) is established along the continuous path as a whole.

The invention is mainly intended for the processing of a length of photosensitive material so that once the leading edge of photosensitive sheet S reached the first pair of blades 215, then the photosensitive sheet S is passing across at least one pair of blades. As a length of photosensitive material S is successively carried through compartments 206A, 206B, 206C, 206D and 206E in this order as shown by arrows in FIG. 17, color developer R1 establishes a steady flow upon every replenishment of color developer R1 and in the same direction as the travel direction of photosensitive sheet S (parallel flow) after the leading edge of photosensitive sheet S has passed the last pair of blades 215 in channel 274 below compartment 206E. The quantity of color developer passed across blades 215 between two adjoining compartments is preferably 0.1 to 100 ml/min., more preferably 0.5 to 50 ml/min. which is substantially coincident with the quantity of color developer replenished.

The freshness of color developer is highest in the first compartment 206A and gradually decreases in compartments 206B, 206C, 206D and 206E in this order. This is because blades 215 provide squeeze effect to minimize the drag-out from a certain compartment to the following one, blades 215 provide substantial blockage of fluid flow except the above-mentioned fluid flow forced by the replenishment of color developer, and color developer R1 is replenished at intervals. Provided that compartments 206A, 206B, 206C, 206D and 206E have concentrations of halide ion such as bromide ion dissolved out from photosensitive sheet S, Cx1, Cx2, Cx3, Cx4 and Cx5, respectively, in the equilibrium state of running operation, which indicate the freshness of color developer in the respective compartments, the following relationship is established.

$Cx2/Cx1 = 1.1$ to 3
$Cx3/Cx1 = 1.3$ to 5
$Cx4/Cx1 = 1.4$ to 6
$Cx5/Cx1 = 1.6$ to 7

The squeezing of blades 215 is also effective in reducing the flow of color developer between the adjacent compartments, for example, by about 10 to 70% per square meter of the photosensitive sheet as compared with rotary type shutter means.

The blades 215 are also effective in breaking a boundary film which will be formed on the emulsion surface of photosensitive sheet S by waste substances resulting from development reaction because blades 215 make physical contact with the emulsion surface. This promotes development, resulting in improved color development efficiency.

At the end of processing, that is, for some time (e.g., 10 to 100 minutes) after photosensitive sheet S is carried out of tank 202, the color developer flows across blades 215 only at a flow rate of 0.0001 to 0.5 ml/min., preferably 0.001 to 0.1 ml/min. in the color developer replenishment direction. The order of freshness of color developer in the respective compartments is generally the same as that during processing.

After the termination of processing, the color developer assumes the same direction and rate of flow as in U the washing apparatus. The freshness of color developer in the respective compartments has the same tendency as the fixing agent in the washing apparatus. This ensures smooth restart of operation.

Although a length of photosensitive material has been described, the apparatus is applicable to discrete sheets of photosensitive material. Parallel flow of color developer is established whenever a sheet passes across pairs of blades 215 in the respective channels. Because the blockage of fluid flow by the remaining blades is not complete, color developer can pass in parallel flow along the continuous processing path as a whole. If a discrete sheet is long enough to extend across all the pairs of blades at the same time, the flow rate of color developer is the same as previously mentioned for a length of photosensitive material. If a discrete sheet is short enough to extend across only two or more pairs of blades at the same time, the flow rate of color developer is 0.1 to 100 ml/min., preferably 0.5 to 50 ml/min. where the color developer is allowed to flow. Where color developer does not flow in principle due to blockage of the blades, the flow rate of color developer during replenishment is 0.1 to 100 ml/min., preferably 0.5 to 50 ml/min. The relationship of freshness of color developer in the respective compartments is approximately the same as previously mentioned for a length of photosensitive material.

Where apparatus 201' of FIG. 17 is applied for bleaching, blix or fixation, the flow rate and other parameters of fluid are in accord with those for the color developer. The freshness of processing fluid in the respective compartment is approximately the same as for the color developer. In addition, there is achieved promoted processing due to boundary film breakage. The carry-in between adjacent compartments by the photosensitive material is reduced.

Figure 18:
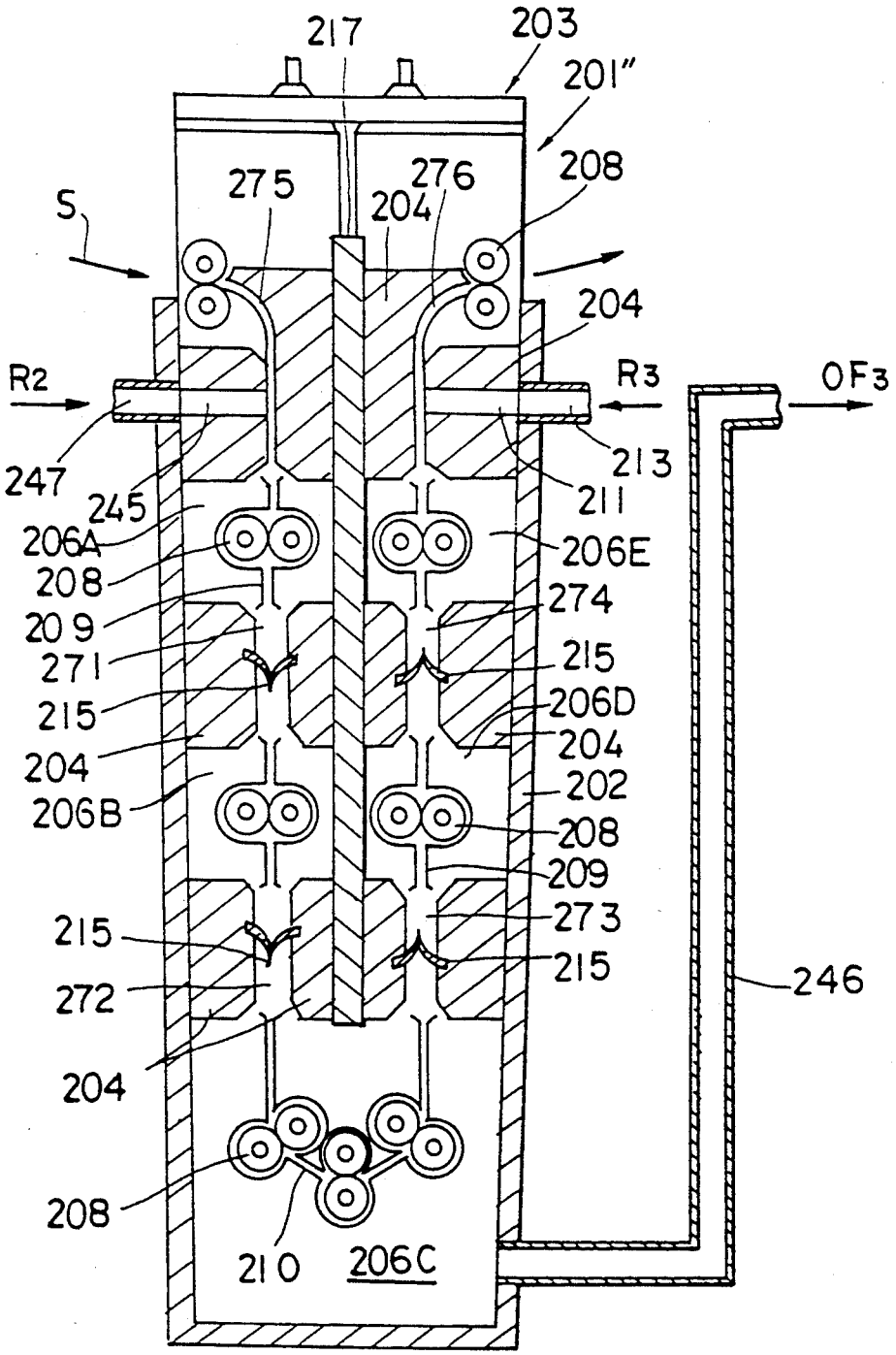
FIG. 18 is a vertical cross section similar to FIG. 9 of a processing apparatus having a pair of blades in each channel, utilizing two types of processing solutions flowing in opposite directions.

When it is desired to carry out a series of desilvering steps, bleaching, blix and fixation in a single tank, an apparatus constructed as shown in FIG. 18 may be used.

The apparatus 201" shown in FIG. 18 is essentially identical with that of FIG. 9 except that the discharge port 212 and discharge pipe 214 associated with the entrance compartment 206A are used as a supply port 245 and supply pipe 247 and a discharge pipe 246 is connected to the lowest compartment 206C such that the solution in the tank may be maintained at the predetermined level. Therefore, the parts corresponding to those in FIG. 9 are designated by the same reference numerals and their description is omitted.

In apparatus 201" of FIG. 18, bleaching and fixing solutions (or their replenishers) R2 and R3 are supplied to the tank through supply pipes 247 and 213 and discharged through discharge pipe 246 as an overflow $OF_3$. The bleaching and fixing solutions R2 and R3 meet in the intermediate compartment 206C to form a blix solution therein. During processing, the bleaching solution provides a flow in the same direction as the travel direction of photosensitive sheet S (parallel flow) whereas the fixing solution provides a flow in the opposite direction to the travel direction of photosensitive sheet S (counter flow).

In apparatus 201" of the illustrated construction, the counter flow of fixing solution does not adversely affect its processing efficiency. Since bleach-fixation proceeds such that only fixation takes place in unexposed undeveloped areas and bleaching takes place first and then fixation takes place in developed areas, it is rather preferred for efficient processing to carry out substantial bleaching in compartment 206A (first compartment) and substantial fixation in compartment 206E (fifth compartment).

In apparatus 201", the fluid flow rate and chemical agent concentration in compartments 206A, 206B and 206C are approximately the same as in the apparatus of FIG. 17 applied to development, and the fluid flow rate and chemical agent concentration in compartments 206C, 206D and 206E are approximately the same as in the apparatus of FIG. 9 applied to water washing.

Although five compartments are defined in the illustrated embodiments, the invention is not limited thereto. In general, the apparatus includes 3 to 30 compartments, preferably 5 to 15 compartments.

As previously described, the wash water, stabilizer, black-and-white developer, color developer, bleaching solution, fixer, blix solution and other solutions which can be used in the apparatus having bladed channels are of well-known formulations and are described in JP-A Nos. 7559/1986, 70857/1988, 190889/1989, 198754/1989, 6050/1989, 93737/1989, 250947/1989, 103035/1990, 3037/1990, and 71260/1990.

The apparatus having bladed channels can be applied to a variety of color and black-and-white photosensitive materials and embodied as a variety of processors as previously mentioned.

The apparatus having bladed channels is effective in maintaining distinct differential concentrations of processing solution in respective compartments over a long period of time both during operating and quiescent periods. Therefore, the apparatus can be compact while improving processing efficiency.

To demonstrate the benefits of the apparatus having bladed channels, we carried out experiments, some of which are given below.

EXPERIMENT 1

An experiment was done using a water washing apparatus of the construction shown in FIGS. 9 to 14 and several apparatus modified therefrom.

Apparatus A

In the illustrated apparatus, each pair of blades was replaced by a rotary shutter assembly which is shown in FIG. 19 as comprising a rotary shutter 216 pivoted with respect to the channel 271 such that the rotary shutter 216 allows fluid flow when positioned in the solid line position, but blocks fluid flow when positioned in the phantom line position. The rotary shutter 216 was formed of EPT rubber where it came in contact with fluid.

Apparatus B

In the illustrated apparatus, a pair of blades having the following specifications were installed in each channel.

Thickness: 1 mm (uniform thickness)
Length: 18 mm (entire length)
Tip overlap: 1.5 mm (with no sheet passing)
Material: silicone rubber
Average inclination: ~45°

Apparatus C

In the illustrated apparatus, a pair of blades having the following specifications were installed in each channel.

Thickness: 1 mm (uniform thickness)
Length: 25 mm (entire length)
Tip overlap: 3 mm (with no sheet passing)
Material: silicone rubber
Average inclination: ~45°

Apparatus D

It was the same as apparatus B except that 3 pairs of blades were used per channel.

In all the apparatus, the compartments each had a volume of about 1,500 ml for compartment 206A, 206B, 206D and 206E and a volume of about 3,000 ml for compartment 206C. The channels each had a breadth of 3 mm and a length of 60 mm between adjoining compartments.

In all the apparatus, the first compartment 206A was filled with wash water containing 10% by volume of blix solution and the second to fifth compartments were filled with fresh wash water. The blix solution used was a P2 solution prepared from processing agent CP40FA available from Fuji Photo-Film Co., Ltd. and the wash water was deionized water. A roll color paper, Fuji Color Paper Super FA available from Fuji Photo-Film Co., Ltd., after requisite processing, was processed through each apparatus for 10 minutes and then the apparatus was allowed to stand over 100 hours.

Figure 20:
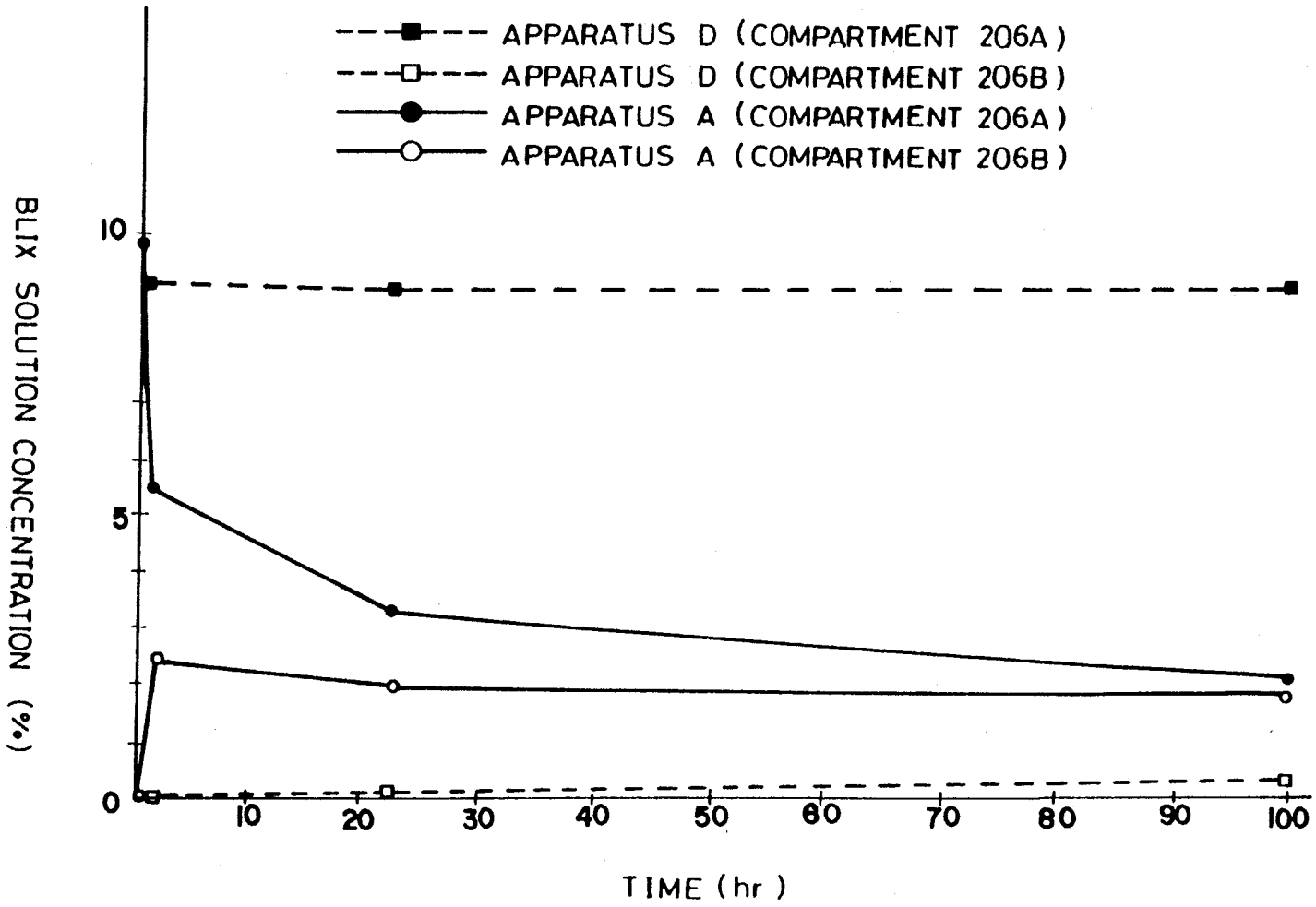
FIG. 20 is a graph showing how the concentration of blix agent in compartments 206A and 206B of apparatus A and D in Experiment 1 changes with time.

Samples were taken from the wash water in the respective compartments at 0 min., 3 min., 10 min., 1 hour, 24 hours, and 100 hours to examine the mixing or leakage of the blix solution. The leakage was determined by measuring the conductivity of solution samples by a conductivity meter and calculating the concentration therefrom using a calibration curve. The results are shown in Table 4 and FIG. 20.

During processing of the photosensitive sheet, wash water was replenished from the fifth compartment 6E in the amount reported in Table 4.

It is to be noted that although the performance of apparatus with rotary shutter means, for example, apparatus A is evaluated relatively poor in Experiments 1 to 3, this evaluation is based on a strict criterion compared with the presently best apparatus with bladed shutter means. When compared with prior art apparatus, apparatus even with rotary shutter means according to the present invention perform quite better as is evident from Examples 1 to 5.

TABLE 4

| Apparatus | Replenisher amount (ml/min.) | Compartment | Blix solution concentration (%) 0 min. | 3 min. | 10 min. | 1 hr. | 24 hr. | 100 hr. |
|---|---|---|---|---|---|---|---|---|
| A (rotary) | 26 | 6E | 0.0 | 0.0 | 0.0 | 0.2 | 0.3 | 0.3 |
| | | 6D | 0.0 | 0.0 | 0.2 | 0.5 | 0.9 | 1.0 |
| | | 6C | 0.0 | 0.1 | 0.3 | 1.2 | 2.3 | 2.5 |
| | | 6B | 0.3 | 0.1 | 0.2 | 2.5 | 2.0 | 1.8 |
| | | 6A | 9.8 | 8.8 | 8.0 | 4.5 | 3.3 | 2.0 |
| B (blade) | 26 | 6E | 0.0 | 0.0 | 0.0 | 0.0 | 0.0 | 0.0 |
| | | 6D | 0.0 | 0.0 | 0.0 | 0.0 | 0.1 | 0.1 |
| | | 6C | 0.0 | 0.0 | 0.0 | 0.2 | 0.4 | 0.6 |
| | | 6B | 0.1 | 0.1 | 0.1 | 0.7 | 1.5 | 2.4 |
| | | 6A | 10.2 | 9.7 | 9.5 | 8.8 | 7.4 | 6.5 |

TABLE 4-continued

| Apparatus | Replenisher amount (ml/min.) | Compartment | Blix solution concentration (%) 0 min. | 3 min. | 10 min. | 1 hr. | 24 hr. | 100 hr. |
|---|---|---|---|---|---|---|---|---|
| C (blade) | 26 | 6E | 0.0 | 0.0 | 0.0 | 0.0 | 0.0 | 0.0 |
| | | 6D | 0.0 | 0.0 | 0.0 | 0.0 | 0.0 | 0.0 |
| | | 6C | 0.0 | 0.0 | 0.0 | 0.0 | 0.1 | 0.2 |
| | | 6B | 0.0 | 0.17 | 0.17 | 0.17 | 0.2 | 0.3 |
| | | 6A | 9.3 | 9.2 | 9.0 | 8.9 | 8.8 | 8.8 |
| D (blade) | 26 | 6E | 0.0 | 0.0 | 0.0 | 0.0 | 0.0 | 0.0 |
| | | 6D | 0.0 | 0.0 | 0.0 | 0.0 | 0.0 | 0.0 |
| | | 6C | 0.0 | 0.0 | 0.0 | 0.0 | 0.0 | 0.01 |
| | | 6B | 0.0 | 0.01 | 0.03 | 0.05 | 0.1 | 0.1 |
| | | 6A | 9.2 | 9.0 | 9.0 | 9.0 | 9.0 | 9.0 |

As is evident from Table 4, apparatus A with rotary type shutter means allowed for about 50% intermixing after 1 hour and about 100% intermixing after 24 hours whereas apparatus B, C and D with blades allowed for only about 35%, 5% and 2% intermixing after 100 hours, respectively, achieving substantial flow blockage. This is also supported by the curves in FIG. 20.

After 100 hours, the movement of wash water took place from compartment 206A to 206C and from compartment 206E to 206C at a flow rate of about 0.008 ml/min.

Using apparatus A to D filled with wash water, the above-identified color paper after proper processing was washed with water while wash water was replenished in the increment shown in Table 5. The color paper was fed at a linear speed of 60 cm/min.

TABLE 5

| Apparatus | Replenisher amount |
|---|---|
| A | 37 ml/min. |
| B | 26 ml/min. |
| C | 26 ml/min. |
| D | 26 ml/min. |

The replenishment increment reported in Table 5 corresponded to the flow rate of wash water through the paired blades in apparatus B, C and D during processing. The concentrations in the respective compartments of a chemical agent entrained from a preceding bath during processing were approximately identical to the data for 1 min. sampling in Table 4.

In apparatus A, the flow rate of wash water through the shutter means was 37 ml/min. during processing.

The blades achieved such squeeze effect that the quantity of chemical agent entrained from a compartment to a subsequent compartment per square meter of photosensitive material was reduced by about 25% as compared with the shutter means of apparatus A.

The color paper samples were compared for photographic property between at the start of running operation and after 5 hours of running operation. In apparatus A, poor water washing as demonstrated by insufficient wash-out of developing agent was observed after the continued running operation whereas in apparatus B to D, a photographic property equivalent to that at the start was maintained after the continued running operation. This indicates that as compared with apparatus A with rotary type shutter means, apparatus B to D with blades provide full blockage of fluid flow except a fluid flow corresponding to replenishment increments and achieve promoted water washing because the blades come in contact with the emulsion surface to break any boundary film which would be formed thereon.

After the apparatus remained quiescent for 100 hours, washing operation was restarted. In apparatus A, poor washing was observed immediately after the restart whereas in apparatus B to D, especially apparatus C and D, good photographic property was obtained immediately from the restart. This is attributable to the enhanced blockage of fluid flow by the blades in apparatus B to D as seen from Table 4.

EXPERIMENT 2

An experiment was done using a processing apparatus of the construction shown in FIG. 18 and another apparatus modified therefrom.

Apparatus E

In the illustrated apparatus, each pair of blades was replaced by a rotary shutter assembly which is shown in FIG. 19 (see apparatus A for detail).

Apparatus F

In the illustrated apparatus, a pair of blades having the following specifications were installed in each channel.

Thickness: 1 mm (uniform thickness)
Length: 25 mm (entire length)
Tip overlap: 3 mm (with no sheet passing)
Material: silicone rubber
Average inclination: ~45°

In both the apparatus, the compartments each had a volume of about 700 ml for compartment 206A, 206B, 206D and 206E and a volume of about 1,500 ml for compartment 206C. The channels each had a breadth of 3 mm and a length of 50 mm between adjoining compartments. The entire processing path had a length of 1200 mm. The travel speed was 60 cm/min.

In apparatus E and F, the first and second compartments 206A, 206B were filled with bleaching solution, the third compartment 206C with blix solution, and the fourth and fifth compartments 206D, 206E with fixer.

The apparatus was incorporated in a system such that an apparatus for color development for 3¼ minutes was followed by the apparatus for bleaching, blix and fixation, which was, in turn, followed by an apparatus for water washing, stabilization and drying. The processing steps are shown in Table 6.

TABLE 6

| Processing step | Temp. | Replenisher amount* |
|---|---|---|
| Color development | 38.0° C. | 46 ml |
| Desilvering (bleach → blix → fix) | 38.0° C. | described later |
| Wash (1)-(2)** | 38.0° C. | 68 ml |
| Stabilization | 38.0° C. | 40 ml |
| Drying | 55° C. | |

*per meter of a 70-mm wide sheet
**counter flow from (2) to (1)

The color developer, bleaching solution, fixer and stabilizer used herein had the following compositions. The blix mother solution used is a mixture of the bleaching mother solution and the fixing mother solution in a ratio of 15:85.

| Ingredients | Mother | Replenisher |
|---|---|---|
| Color Developer | | |
| Diethylene triamine pentaacetate | 2.0 g | 2.2 g |
| 1-hydroxyethylidene-1,1-diphosphonic acid | 3.3 g | 3.3 g |
| Sodium sulfite | 3.9 g | 5.2 g |
| Potassium carbonate | 37.5 g | 39.0 g |
| Potassium bromide | 1.4 g | 0.4 g |
| Potassium iodide | 1.3 mg | — |
| Hydroxylamine hydrogen sulfate | 2.4 g | 3.3 g |
| 2-methyl-4-[N-ethyl-N-(β-hydroxyethyl)-amino]aniline hydrogen sulfate | 4.5 g | 6.1 g |
| Water totaling to | 1.0 l | 1.0 l |
| pH | 10.05 | 10.15 |
| Bleaching solution | | |
| Ammonium iron (III) 1,3-propylene-diamine tetraacetate monohydrate | 144.0 g | 206.0 g |
| Ammonium bromide | 84.0 g | 120.0 g |
| Ammonium nitrate | 17.5 g | 25.0 g |
| Hydroxyacetic acid | 63.0 g | 90.0 g |
| Acetic acid (98%) | 33.2 g | 47.4 g |
| Water totaling to | 1.0 l | 1.0 l |
| pH (adjusted with aqueous ammonia) | 3.60 | 3.20 |
| Fixer | | |
| Ammonium sulfite | 19.0 g | 57.0 g |
| Aqueous ammonium thiosulfate (700 g/l) | 280 ml | 840 ml |
| Imidazole | 28.5 g | 85.5 g |
| Ethylenediamine tetraacetate | 12.5 g | 37.5 g |
| Water totaling to | 1.0 l | 1.0 l |
| pH (adjusted with aqueous ammonia and acetic acid) | 7.40 | 7.45 |

| Stabilizer | Mother/Replenisher |
|---|---|
| Formalin (37%) | 2.0 ml |
| Polyoxyethylene-p-monononylphenyl ether (average polymerization degree 10) | 0.3 g |
| Disodium ethylenediamine tetraacetate | 0.05 g |
| Water totaling to | 1.0 l |
| pH | 5.8–8.0 |

Wash Water (Mother/Replenisher)

City water was passed through a mixed bed column loaded with an H type strong acid cation-exchange resin (Amberlite ® IR-120B by Rohm & Haas Co.) and an OH type anion-exchange resin (Amberlite ® IR-400) to reduce the calcium and magnesium ion concentrations to 3 mg/l or lower. To the deionized water were added 20 mg/l of sodium isocyanurate dichloride and 150 mg/l of sodium sulfate. This liquid was at pH 6.5 to 7.5.

A processing test was carried out in a running mode using Fuji Color Negative Film HR100 (70 mm wide) available from Fuji Photo-Film Co., Ltd. The bleaching, blix and fixing times were 40, 40 and 40 seconds, respectively. The color negative films were continuously processed for 5 hours. Samples were taken from the solutions in compartments 206A and 206E at intervals of 1 hour, that is, immediately after the start and 1, 2, 3, 4 and 5 hours from the start, examining the intermixing or leakage of the bleaching and fixing solutions. The leakage was determined by analyzing the concentration of iron and ammonium thiosulfate (ATS) in solution samples. The results are shown in Table 7 and FIG. 21.

During processing of the photosensitive material, the bleaching replenisher was supplied to the first compartment 206A and the fixing replenisher supplied to the fifth compartment 206E. The amounts of bleaching and fixing solutions replenished were 5.5 ml/min. for the bleaching solution and

54 ml/min. for the fixing solution in apparatus F with blades, the replenisher amounts being flow rates of the respective solutions across the blades. In apparatus E with rotary type shutter means, the replenisher amounts were 5.5 ml/min. in the parallel flow direction and 54 ml/min. in the counter flow direction both during processing.

It was found that due to the squeeze effect of its blades, apparatus F reduced the carry-in per square meter of photosensitive material in the parallel flow direction to approximately 40% of that of apparatus E.

TABLE 7

| Apparatus | Compartment | Concentration | Continuous operation Start | 1 hr. | 2 hr. | 3 hr. | 4 hr. | 5 hr. |
|---|---|---|---|---|---|---|---|---|
| E (rotary) | 6A | Fe (g/l) | 12.4 | 7.6 | 6.0 | 5.3 | 5.2 | 5.5 |
| | | ATS (ml/l) | 52 | 121 | 158 | 171 | 190 | 217 |
| | 6E | Fe (g/l) | 0.05 | 0.19 | 0.05 | 0.08 | 0.12 | 0.22 |
| | | ATS (ml/l) | 277 | 265 | 243 | 212 | 158 | 215 |
| F (blade) | 6A | Fe (g/l) | 14.4 | 12.3 | 13.1 | 12.1 | 12.5 | 12.8 |
| | | ATS (ml/l) | 13 | 21 | 18 | 20 | 19 | 15 |
| | 6E | Fe (g/l) | 0.0 | 0.0 | 0.0 | 0.0 | 0.0 | 0.0 |
| | | ATS (ml/l) | 280 | 270 | 265 | 270 | 270 | 260 |

As seen from Table 7, in apparatus E with rotary type shutter means, the concentration of bleaching solution in compartment 206A lowered markedly after 1 hour and to 40% of the initial one after 5 hours due to intermixing. In contrast, apparatus F with blades maintained the solutions well confined since the bleaching solution in compartment 206A showed a concentration lowering of less than 15%. The same tendency was found with respect to the concentration of fixing solution in compartment 206E.

Figure 21:
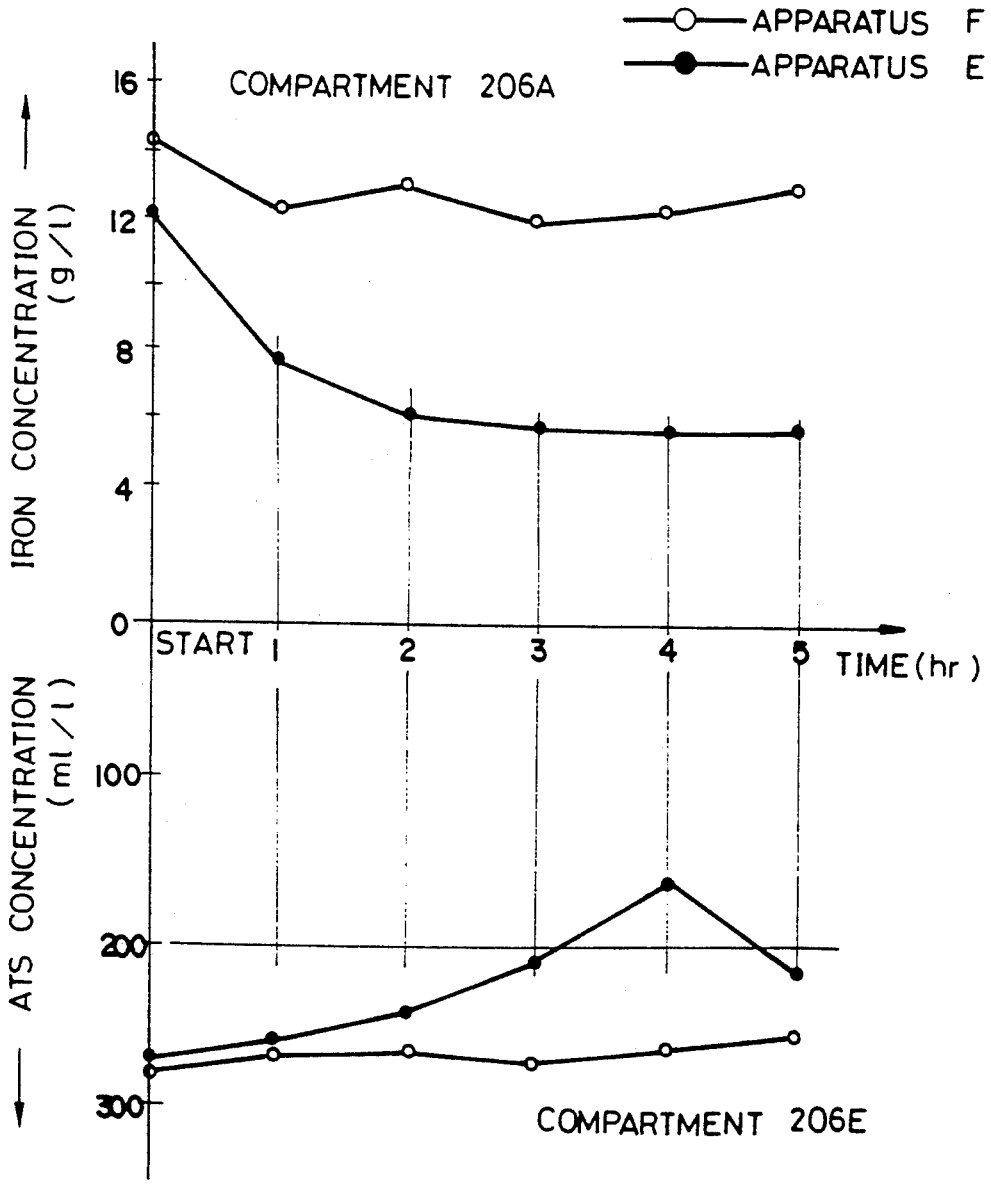
FIG. 21 is a graph showing how the concentration of iron and ATS in solution in compartments 206A and 206E of apparatus E and F in Experiment 2 changes with time.

Films were processed through the systems after 5 hours of running operation for determining the amount of residual silver on the films. The residual silver amount was 30 to 50 $\mu g/cm^2$ in apparatus E, but at most 5 $\mu g/cm^2$ in apparatus F. The significant improvement by the blades in apparatus F is also supported by the graph of FIG. 21 showing how the concentration of iron and ATS in solution samples changed with time. The improved processing efficiency is also attributable to the fact that the blades come in contact with the emulsion surface of photosensitive material to break any boundary film which would be formed thereon by used and waste substances resulting from processing.

EXPERIMENT 3

The washing apparatus A and B in Experiment 1 were used as color developing apparatus G and H, respectively, except that they were filled with a color developer instead of wash water and the replenishing direction was reversed as shown in FIG. 17 to provide parallel flow of the color developer. The same color negative films as used in Experiment 2 were processed. The processing steps were in accord with Experiment 2. Conventional processing tanks were utilized for processing steps other than the color development step. The color developer and other processing solutions were the same as formulated in Experiment 2.

For comparison purposes, a conventional color developing tank was also used to carry out similar development.

A change in photographic properties, i.e., sensitivity and gradation was examined after 3 rounds of processing in the color developing tank. The sensitivity is a relative sensitivity based on a sensitivity of 100 for processing in the conventional color developing tank with a replenisher amount of 46 ml per meter of 70 mm wide film. The gradation is an average gradation in a linear zone of a curve representative of the characteristic of the green-sensitive layer as a typical indication.

The results are shown in Table 8. Also reported in Table 8 are the amounts of color developer replenished which are the flow rates of the solution across the rotary and blade type shutter means of apparatus G and H, with some adjustment if necessary.

TABLE 8

| | Photographic properties | | | |
|---|---|---|---|---|
| Apparatus | Replenisher amount* | Sensitivity | Gradation | Overall Evaluation |
| G | 41 ml | 109 | 2.7 | Good |
| (rotary) | 37 ml | 88 | 2.7 | Fair |
| H | 37 ml | 112 | 2.7 | Good |
| (blade) | 32 ml | 97 | 2.7 | Good to Fair |
| Tank** | 46 ml | 100 | 2.7 | Good |
| | 41 ml | 89 | 2.9 | Poor |
| | 37 ml | 73 | 2.6 | very poor |
| | 32 ml | 50 | 2.3 | ex. poor |

*per meter of 70 mm wide film
**prior art

The data in Table 8 show that apparatus H achieved a significant improvement in photographic properties due to the squeeze action of blades.

At least equivalent results to those of the apparatus with blade pairs were obtained when Experiments 1, 2 and 3 were repeated, but using an integral blade assembly as shown in FIG. 15 instead of the blade pair.

Obviously many variations and modifications of the present invention are possible in the light of the above teachings. It is therefore to be understood that within the scope of the appended claims, the invention may be practiced otherwise than as specifically described.

We claim:

1. A method for wet processing a photosensitive material, comprising the steps of providing a processing tank whose interior chamber is partitioned into a plurality of serially arranged compartments filled with processing solution, adjacent compartments being allowable for fluid communication, successively passing the photosensitive material through the compartments without contact with the ambient atmosphere, and providing a flow of processing solution through the compartments in counter flow relationship to the travel of the photosensitive material.

2. The method of claim 1 wherein as processing of photosensitive material is repeated, a gradient is developed in solution composition among the compartments, which method further comprises maintaining the gradient in solution composition among the compartments.

3. A method for wet processing a photosensitive material, comprising the steps of providing a processing tank whose interior chamber is partitioned into a plurality of serially arranged compartments filled with processing solution, adjacent compartments being allowable for fluid communication, successively passing the photosensitive material through the compartments while maintaining continuous contact with the solution, and providing a flow of processing solution through the compartments in counter flow relationship to the travel of the photosensitive material.

4. The method of claim 3 wherein as processing of photosensitive material is repeated, a gradient is developed in solution composition among the compartments, which method further comprises maintaining the gradient in solution composition among the compartments.

5. An apparatus for wet processing a photosensitive material, comprising a processing tank for defining an interior chamber, means for partitioning the tank chamber into a plurality of serially arranged compartments, the compartments being filled with processing solution, and means for successively passing the photosensitive material through the compartments while maintaining continuous contact with the solution, wherein said partition means is designed such that any two adjoining compartments being in little fluid communication with each other during quiescent periods when no photosensitive material travels, and in fluid communication with each other during operating periods when the photosensitive material travels.

6. The apparatus of claim 5 which further comprises means for providing a flow of processing solution through the compartments in counter flow relationship to the travel of the photosensitive material.

7. The apparatus of claim 5 which further comprises means for providing a flow of processing solution through the compartments in parallel flow relationship to the travel of the photosensitive material.

8. The apparatus of claim 5 which further comprises means for providing a flow of processing solution perpendicular to the travel direction of the photosensitive material.

9. The apparatus of claim 5 which further comprises shutter means for blocking substantial communication between the adjoining compartments during quiescent periods when no photosensitive material travels, but allowing communication between the adjoining compartments during operating periods when the photosensitive material travels.

10. The apparatus of claim 5 wherein the tank comprises at least two configured blocks which define the plurality of compartments and channels communicating the compartments when mated.

11. An apparatus for wet processing a photosensitive material, comprising a processing tank for defining an interior chamber, means for partitioning the tank chamber into a plurality of serially arranged compartments, the compartments being filled with processing solution, means for successively passing the photosensitive material through the compartments while maintaining continuous contact with the solution, and shutter means for blocking substantial communication between adjoining compartments during quiescent periods when no photosensitive material travels, but allowing communication between the adjoining compartments during operating periods when the photosensitive material travels.

12. The apparatus of claim 11 which further comprises means for providing a flow of processing solution through the compartments in counter flow relationship to the travel of the photosensitive material.

13. The apparatus of claim 11 which further comprises means for providing a flow of processing solution through the compartments in parallel flow relationship to the travel of the photosensitive material.

14. The apparatus of claim 11 which further comprises means for providing a flow of processing solution perpendicular to the travel direction of the photosensitive material.

15. The apparatus of claim 11 wherein the tank comprises at least two configured blocks which define the plurality of compartments and channels communicating the compartments when mated.

* * * * *